United States Patent [19]

Kato et al.

[11] 4,145,219

[45] Mar. 20, 1979

[54] MULTILAYER COLOR SENSITIVE MATERIALS

[75] Inventors: Takeshi Kato; Akira Tanaka; Jun Hayashi; Akikazu Mikawa, all of Minami-ashigara, Japan

[73] Assignee: Fuji Photo Film Co., Ltd., Minami-ashigara, Japan

[21] Appl. No.: 813,738

[22] Filed: Jul. 7, 1977

[30] Foreign Application Priority Data

Jul. 7, 1976 [JP] Japan ..... 51-81142

[51] Int. Cl.[2] ..... G03C 1/10; G03C 1/34; G03C 1/76

[52] U.S. Cl. ..... 96/74; 96/109; 96/100 R; 96/100 N

[58] Field of Search ..... 96/95, 74, 66.3, 22, 96/3, 109, 100

[56] References Cited

U.S. PATENT DOCUMENTS

| | | | |
|---|---|---|---|
| 3,620,746 | 11/1971 | Barr | 96/3 |
| 3,663,228 | 5/1972 | Wyckoff | 96/74 |
| 3,930,863 | 1/1976 | Shiba et al. | 96/95 X |
| 3,932,185 | 1/1976 | Matsuura | 96/74 |

*Primary Examiner*—Edward C. Kimlin
*Assistant Examiner*—Alfonso T. Suro Picó
*Attorney, Agent, or Firm*—Sughrue, Rothwell, Mion, Zinn and Macpeak

[57] ABSTRACT

A silver halide multilayer color sensitive material comprising a red-sensitive silver halide emulsion layer, a green-sensitive silver halide emulsion layer and a blue-sensitive silver halide emulsion layer on a support, wherein each silver halide emulsion layer contains a non-diffusible image forming coupler, the improvement which comprises at least one of the silver halide emulsion layers comprising an upper unit silver halide emulsion layer, a middle unit silver halide emulsion layer and a lower unit silver halide emulsion layer, in which the sensitivity of the three unit silver halide emulsion layers decreases in order from the upper unit silver halide emulsion layer to the lower unit silver halide emulsion layer, and at least the middle unit silver halide emulsion layer contains a development inhibitor releasing compound.

12 Claims, No Drawings

MULTILAYER COLOR SENSITIVE MATERIALS

BACKGROUND OF THE INVENTION

1. Field of the Invention

The present invention relates to multilayer color sensitive materials and, in detail, to high speed silver halide multilayer color sensitive materials providing images with a fine granularity comprising a red-sensitive silver halide emulsion layer, a green-sensitive silver halide emulsion layer and a blue-sensitive silver halide emulsion layer wherein at least one of these light-sensitive layers is composed of an upper unit silver halide emulsion layer, a middle unit silver halide emulsion layer and a lower unit silver halide emulsion layer.

2. Description of the Prior Art

High speed color light-sensitive materials for photography providing images with a fine granularity are well known in the art. For example, high speed multilayer color light-sensitive materials comprising a red-sensitive silver halide emulsion layer, a green-sensitive silver halide emulsion layer and a blue-sensitive silver halide emulsion layer, wherein at least one of the light-sensitive emulsion layers is composed of three unit emulsion layers which are positioned so that the sensitivity of each unit emulsion layer decreases in order of the upper unit emulsion layer, the middle unit emulsion layer and the lower unit emulsion layer are described in U.S. Pat. No. 3,843,469. (As used herein, the terms "upper," "middle" and "lower" are with respect to incident light of exposure with upper being closest to this incident light of exposure.) On the other hand, high speed multilayer color light-sensitive materials comprising a red-sensitive silver halide emulsion layer, a green-sensitive silver halide emulsion layer and a blue-sensitive silver halide emulsion layer, at least one of which is composed of plural layers which are sensitive to light in the same spectral range, wherein the low speed lower unit emulsion layer contains a DIR coupler, are described in Japanese Patent Application (OPI) No. 42,345/74 (corresponding to U.S. patent application Ser. No. 249,630, filed May 2, 1972). However, in high speed multilayer color light-sensitive materials comprising three unit layers of the type as described in U.S. Pat. No. 3,843,469, although color images with a fine granularity are attained to some degree, the color images still have insufficient granularity and the light-sensitive materials have the defect that the image sharpness is deteriorated. In the color light-sensitive materials described in Japanese Patent Application (OPI) No. 42,345/74, the color images with a fine granularity are still insufficient for a high sensitivity to be obtained.

SUMMARY OF THE INVENTION

A first object of the present invention is to provide high speed multilayer color light-sensitive materials having a remarkably improved color image granularity.

A second object is to provide high speed multilayer color light-sensitive materials providing a fine granularity with good image sharpness.

A third object is to provide high speed fine granularity multilayer color light-sensitive materials in which curling occurs with difficulty.

These objects of the present invention have been attained with a silver halide multilayer color light-sensitive material comprising a red-sensitive silver halide emulsion layer, a green-sensitive silver halide emulsion layer and a blue-sensitive silver halide emulsion layer on a support, each silver halide emulsion layer containing a non-diffusible image forming coupler, wherein at least one of the light-sensitive silver halide emulsion layers comprises an upper unit silver halide emulsion layer, a middle unit silver halide emulsion layer and a lower unit silver halide emulsion layer, with each of the three unit silver halide emulsion layers being sensitive to visible light in the same spectral wavelength range, with the sensitivity of the unit silver halide emulsion layers decreasing towards the lower unit silver halide emulsion layer, and with at least the middle unit silver halide emulsion layer of the three unit silver halide emulsion layers containing a DIR compound.

DETAILED DESCRIPTION OF THE INVENTION

The grain size of the silver halide grains in the emulsions used for the upper unit silver halide emulsion layer (hereinafter, for brevity, upper unit emulsion layer) of the unit silver halide emulsion layers (hereinafter, for brevity, unit emulsion layers) is preferably such that at least about 10% by weight, preferably 20% by weight and particularly preferably 40% by weight, based on the total silver halide grains in the upper unit emulsion layer has a diameter of about 1.0μ or larger or that the average grain size of the silver halide grains in the upper unit emulsion layer is about 1.0μ or more. It is further preferred for the upper unit emulsion layer to be composed of a high speed silver halide emulsion wherein more than about 3% and preferably more than 5% based on the total grains in the upper unit emulsion layer to be composed of large grains having a grain size of about 2.0μ or larger. Further, in the unit emulsion layers, the difference in the sensitivity between the upper unit emulsion layer and the middle unit emulsion layer, the difference in the sensitivity between the middle unit emulsion layer and the lower unit emulsion layer and the difference in the sensitivity between the upper unit emulsion layer and the lower unit emulsion layer are each about 0.15 log E to about 1.3 log E, about 0.1 log E to about 0.7 log E and about 0.3 log E to about 1.5 log E, respectively, wherein E is the exposure amount in lux-seconds. In the unit emulsion layers, the thickness of the upper unit emulsion layer, that of the middle unit emulsion layer and that of the lower unit emulsion layer are each about 0.5 to about 10μ. In the unit emulsion layers, at least a colorless image-forming coupler having a high coupling rate reactivity is incorporated in the upper unit emulsion layer having the highest sensitivity. Particularly, it is preferred for a colorless yellow coupler having a high coupling rate reactivity to be incorporated in the uppermost unit emulsion layer of the light-sensitive material, for example, a blue-sensitive uppermost unit emulsion layer when the blue-sensitive emulsion layer is composed of three unit emulsion layers, because the sharpness is highly improved. In the unit emulsion layers, the amount of couplers in the upper unit emulsion layer is reduced so that the molar ratio of the silver halide to the coupler is about 20:1 to about 150:1, and preferably 40:1 to 120:1, by which the maximum color density of the image becomes about 0.6 to about 0.1, while the molar ratios of the silver halide to the coupler in the middle unit emulsion layer and that in the lower unit emulsion layer are about 10:1 to about 100:1 and about 2:1 to about 5:1, respectively. The amount of silver used in each unit emulsion layer is about 0.1 to about 5 g/m$^2$. If a DIR compound is incorporated in the middle unit emulsion layer of the unit emulsion layers in an amount of about 0.01 to about 40% by mol and preferably 0.1 to 10% by mol based on the total couplers in the middle unit emulsion layer, the effect of the present invention is remarkably attained. The DIR compound can, if desired, be incorporated in the upper unit emulsion layer and/or the lower unit emulsion layer and the DIR compound is usually incorporated in the upper unit emulsion layer and the lower unit emulsion layer in an amount of 0 to about 5 mol% and about 0.05 to about 40 mol%, respectively, based on the total couplers in each unit emulsion layer. However, if the DIR compound is sufficiently incorporated in the uppermost unit emulsion layer of the unit emulsion layers, the γ-value is remarkably deteriorated. In order to compensate for this defect, it is necessary to increase the coating amount, and, consequently, the film thickness increases to cause defects in that the sharpness of the images is deteriorated and curling occurs easily. As a result, about 5 mol% or less of the DIR compound based on the total couplers present in the upper unit emulsion layer is appropriate.

Suitable couplers used for the silver halide multilayer color light-sensitive materials of the present invention preferably are selected from couplers having non-diffusible groups as described in U.S. Pat. Nos. 2,920,961, 2,875,057, 3,418,129, 3,658,544, 3,681,076, 3,062,653 and 2,474,293, British Patent No. 1,201,943, German Patent Application (OLS) No. 2,216,578 and Japanese Patent Applications Nos. 35,379/73 and 69,383/73.

Yellow couplers capable of being used in the present invention can be selected from those yellow couplers described in U.S. Pat. Nos. 3,265,506, 3,728,658, 3,369,895, 3,582,322, 3,408,194, 3,415,652 and 3,253,924, British Patents 1,286,411, 1,040,710, 1,302,398 and 1,204,680, German Patent Applications (OLS) Nos. 1,956,281, 2,162,899 and 2,213,461 and Japanese Patent Application No. 3,039/72.

Specific examples of preferred yellow couplers which can be used in this invention include the following compounds.

α-{3[α-(2,4-Di-tert-amylphenoxy)butyramido]benzoyl}-2-methoxyacetanilide;

α-Acetoxy-α-3-[γ-(2,4-di-tert-amylphenoxy)-butyramido]benzoyl-2-methoxyacetanilide;

N-(4-Anisoylacetamidobenzenesulfonyl)-N-toluidine;

α-(2,4-dioxo-5,5-dimethyloxazolidin-3-yl)-α-pivaloyl-2-chloro-5-[α-(2,4-di-tert-amylphenoxy)-butyramido]acetanilide;

α-(4-Carboxyphenoxy)-α-pivaloyl-2-chloro-5-[α-(2,4-di-tert-amylphenoxy)butyramido]acetanilide;

α-(1-Benzyl-2,4-dioxohydantoin-3-yl)-α-pivaloyl-2-chloro-5-[α-(2,4-di-tert-amylphenoxy)-butyramido]acetanilide;

α-(4-Methoxybenzoyl)-α-(3,5-dioxomorpholin-4-yl)-5-[γ-(2,4-di-tert-amylphenoxy)butyramido]-2-chloroacetanilide;

α-(2,4-Dioxo-5,5-dimethyloxazolidin-3-yl)-α-pivaloyl-2-chloro-5-(hexadecylsulfonylamino)acetanilide;

α-(1-Benzyl-5-ethoxy-2,4-dioxohydantoin-3-yl)-α-pivaloyl-2-methoxy-5-(tetradecyloxycarbonyl-)acetanilide;

α-(2,4-Dioxo-5,5-dimethylhydantoin-3-yl)-α-pivaloyl-2-chloro-5-[α-(2,4-di-tert-amylphenoxy)-butyramido]acetanilide;

α-(1-Benzyl-2,4-dioxo-5-ethoxyhydantoin-3-yl)-α-pivaloyl-2-chloro-5-(hexadecylsulfonylamino)acetanilide;

α-(1-Methyl-2,4-dioxo-5-methoxyhydantoin-3-yl)-α-pivaloyl-2-methoxy-5-[N-γ-(2,4-di-tert-amylphenoxy)-propylsulfamoyl]acetanilide;

α-(1-Benzyl-2,4-dioxo-5-phenylhydantoin-3-yl)-α-pivaloyl-2-chloro-5-[γ-(2,4-di-tert-amylphenoxy)-butyramido]acetanilide;

α-(5,5-Dimethyl-2,4-dioxooxazolidin-3-yl)-2-pivaloyl-2-chloro-5-[γ-(2,4-di-tert-amylphenoxy)-butyramido]acetanilide;

α-(1-Benzyl-2,4-dioxo-5-ethoxyhydantoin-3-yl)-α-pivaloyl-2-chloro-5-dodecyloxycarbonylacetanilide;

α-(1-Carbonylmethyl-2,4-dioxohydantoin-3-yl)-α-pivaloyl-2-chloro-5-[(2,4-di-tert-amylphenoxy)acetamido]acetanilide;

α-(N-Phthalimido)-α-pivaloyl-2-chloro-5-hexadecyloxycarbonylacetanilide;

α-(2,4-Dioxo-5,5-dimethylhydantoin-3-yl)-α-(4-methoxybenzoyl)-2-chloro-5-[γ-(2,4-di-tert-amylphenoxy)butyramido]acetanilide;

α-(N-Phthalimido)-α-benzoyl-2-methoxy-5-(tetradecyloxycarbonyl)acetanilide;

α-(1-Benzyl-2,4-dioxo-5-ethoxyhydantoin-3-yl)-α-(4-methoxybenzoyl)-2-chloro-5-[α-(2,4-di-tert-amylphenoxy)butyramido]acetanilide;

α-(1-Methyl-2,4-dioxo-5-methoxyhydantoin-3-yl)-α-(2-methylbenzoyl)-2-chloro-5-(dodecyloxycarbonyl-)acetanilide;

α-(2,4-Dioxo-5,5-dimethyloxazolidin-3-yl)-α-{3-[(2,4-di-tert-amylphenoxy)acetamido]benzoyl}-2-methoxyacetanilide.

In addition, Yellow Couplers Y - 1 to Y - 6 described hereinafter can also be used.

Magenta couplers capable of being used in the present invention can be selected form those magenta couplers described in U.S. Pat. Nos. 2,600,788, 3,558,319, 3,468,666, 3,419,391, 3,311,476, 3,253,924, and 3,311,476, British Patent No. 1,293,640 and Japanese Patent Applications Nos. 21,454/73 and 45,971/73.

Specific examples of preferred magenta couplers include the following compounds.

1-(2,4,6-Trichlorophenyl)-3-[3-(2,4-di-tert-amylphenoxyacetamido)benzamido]-5-pyrazolone;

1-(2,4,6-Trichlorophenyl)-3-[3-(2,4-di-tert-amylphenoxyacetamido)benzamido]-4-acetoxy-5-pyrazolone;

1-(2,4,6-Trichlorophenyl)-3-tetradecanamido-4-(4-hydroxyphenylazo)-5-pyrazolone;

1-(2,4,6-Trichlorophenyl)-3-[(2-chloro-5-tetradecanoylamino)anilino]-5-pyrazolone;

1-(2,4,6-Trichlorophenyl)-3-[(2-chloro-5-tetradecyloxycarbonyl)anilino]-4-(1-naphthylazo)-5-pyrazolone;

1-(2,4-Dichloro-6-methoxyphenyl)-3-[(2-chloro-5-tetradecanoylamino)anilino]-4-benzyloxycarbonyloxy-5-pyrazolone;

1-(2,4,6-Trichlorophenyl)-3-[3-(2,4-di-tert-amylphenoxyacetamido)benzamido]-4-piperidino-5-pyrazolone;

1-(2,4,6-Trichlorophenyl)-3-{2-chloro-5-[α-(2,4-di-tert-amylphenoxy)butyramido]anilino}-4-N-phthalimido-5-pyrazolone;

1-(2,4,6-Trichlorophenyl)-3-[(2-chloro-5-tetradecanoylamino)anilino]-4-(3-methyl-4-hydroxyphenylazo)-5-pyrazolone.

In addition, Magenta Couplers M - 1 to M - 8 described hereinafter can also be used.

Cyan couplers capable of being used in the present invention can be selected from those cyan couplers described in U.S. Pat. Nos. 2,369,929, 2,474,293, 3,591,383, 2,895,826, 3,458,315, 3,311,476, 3,419,390, 3,476,563 and 3,253,924 and British Patent 1,201,110.

Specific examples of preferred cyan couplers include the following compounds.

1-Hydroxy-N-[γ-(2,4-di-tert-amylphenoxy)propyl]-2-naphthamide;

1-Hydroxy-4-[2-(2-hexyldecyloxycarbonyl)phenylazo]-N-(1-naphthyl)-2-naphthamide;

1-Hydroxy-4-chloro-N-[α-(2,4-di-tert-amylphenoxy)-butyl]-2-naphthamide;

5-Methyl-4,6-dichloro-2-[α-(3-n-pentadecylphenoxy)-butyramido]phenol;

1-Hydroxy-4-[2-(ethoxycarbonyl)phenylazo]-N-(2-ethylhexyl)-2-naphthamide.

In addition, Cyan Couplers C - 1 to C - 8 described hereinafter can also be used.

The following compounds can be used as colored couplers in the present invention.

Colored magenta couplers capable of being used can be selected from those colored magenta couplers described in U.S. Pat. Nos. 2,434,272, 3,476,564 and 3,476,560 and Japanese Patent Application No. 45,971/73.

Colored cyan couplers capable of being used in the present invention can be selected from those colored cyan couplers described in U.S. Pat. Nos. 3,034,892, 3,386,301 and 2,434,272.

Colorless couplers capable of being used in the present invention can be selected from those colorless couplers described in British Patent Nos. 861,138, 914,145 and 1,109,963, Japanese Patent Publication 14,033/70, U.S. Pat. No. 3,580,722 and *Mitteilungen aus den Forshungs Laboratorien der Agfa Leverkusen,* Vol. 4, pages 352–367 (1964).

It is well known that the reactivity of couplers varies depending on the method of dispersing them. When an oil dispersion or polymer dispersion where the coupler is protected by an oil or a polymer and dissolved therein, the reactivity is generally low. When the couplers are added as an aqueous alkaline solution to the emulsion or added directly to the emulsion as a solution in a solvent having a low boiling point which can be removed after preparation of the emulsion layer (namely, an aqueous alkaline solution dispersion and a solid dispersion), the reactivity is high.

However, it is not always possible to practically utilize the above described four dispersion methods, because each coupler has a chemical structure which may not be suitable for the above-described dispersion methods. Accordingly, it is preferred to choose the chemical structure which is the most suitable for each dispersion method.

The image forming coupler having a high rate reactivity and the image forming coupler having a low rate reactivity used in the present specification are distinguished on the basis of a relative coupling rate as described in U.S. Pat. No. 3,726,681 (for example, the relative coupling rate is measured by a method described in *Milleilungen aus den Forshungs Laboratorien der Agfa Leuerkusen-München,* Vol. 3, page 81). With cyan image forming couplers, magenta image forming couplers and yellow image forming couplers, the coupling rate of couplers having a high coupling rate reactivity is about 2 to about 20 times and preferably 3 to 5 times higher than that of couplers having a low coupling rate reactivity. The three unit emulsion layers composing the silver halide photographic emulsion layer, namely, the upper emulsion layer having a high sensitivity, the middle emulsion layer having a middle sensitivity and the lower emulsion layer having a low sensitivity, which are each sensitive to the same spectral wavelength range, contain each a coupler which forms images having substantially the same color, for example, one of cyan, magenta and yellow images. In this case, it is preferred for improving sharpness to incorporate the coupler having a high coupling rate reactivity in the corresponding upper emulsion layer having a high sensitivity, because the amount of the emulsion is small.

The high coupling rate reactivity of the couplers in the present invention can be attained by selecting an appropriate coupler having a suitable chemical structure and/or by introducing the coupler into the emulsion layer using a suitable method. In general, a low coupling rate results where a method which comprises introducing the coupler as an oil drop dispersion is employed.

Preferred couplers having a high coupling rate reactivity in the present invention are couplers having the following general formulae.

(Cyan Couplers)

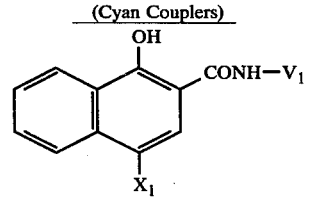

(I)

In the formula (I), $X_1$ represents a hydrogen atom, an alkoxy group having 1 to 4 carbon atoms which may be unsubstituted or substituted with one or more of, e.g., an aryloxy group, a carbamoyl group, a 6-(benzothiazolinylideneamino)benzotriazolyl group, an aryloxycarbonyl group, a halogen atom, an N-heterocyclic group, etc., or a monocyclic or bicyclic aryloxy group having 6 to 10 carbon atoms which may be unsubstituted or substituted with one or more of, e.g., a 4{α[3-(pentadecyl)phenoxy]butyramido} group, a 4-acetylaminonaphthyl-2-azo group, a 4-(1-hydroxy-3,6-disulfo-8-acetylamino-2-naphthyl-2-azo group, etc., and $V_1$ represents an unsubstituted alkyl group having 10 to 20 carbon atoms (e.g., a dodecyl group, etc.), an acylaminoalkyl group having 10 to 20 carbon atoms in the alkyl moiety (e.g., 2-(α-sulfooctadecanoylamino)ethyl, etc.) or a disubstituted phenyl group (e.g., a

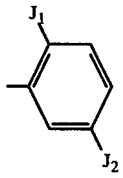

group wherein $J_1$ represents a dialkylamino group having 2 to 24 carbon atoms in total such as an N-methyl-N-octadecylamino group, an N-ethyl-N-dodecylamino group, etc., a halogen atom such as a chlorine atom, etc., or an alkoxy group having 1 to 12 carbon atoms such as a methoxy group, etc., and $J_2$ represents a sulfo group, an N-alkylsulfamoyl group having 1 to 18 carbon atoms such as an N-ethylsulfamoyl group, etc., a carboxyl group, or an alkoxycarbonyl group having 2 to 24 carbon atoms in the alkoxy moiety, such as a tetradecyloxycarbonyl group).

(Magenta Couplers)

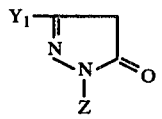

(II)

In the formula (II), $Y_1$ represents an alkyl group having 12 to 20 carbon atoms (e.g., a heptadecyl group, etc.), an acylamino group having 12 to 20 carbon atoms (e.g., an octadecanoylamino group, a 2-tetradecanamido-5-chlorobenzoylamino group, a tetradecanoylamino group, etc.) or a substituted phenylamino group having 15 to 30 carbon atoms (e.g., a 3-[(2-heptadecyl)succinimido]phenylamino group, a 2-chloro-5-octadecylsuccinimidophenylamino, etc.), and Z represents a substituted phenyl group substituted with one or more of a sulfo group, a phenoxy group, a halogen atom such as a 2-chlorophenyl group, a 2,4,6-trichlorophenyl group, etc.

(Yellow Couplers)

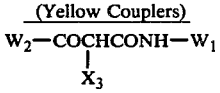

(III)

In the formula (III), $X_3$ represents a hydrogen atom or a cyclic amido group containing a 5- or 6-membered heterocyclic ring which may be condensed with a benzene ring (e.g., a 3-benzyl-4-ethoxy-2,5-dioxoimidazoly group, a 3-phenyl-4-benzyl-2,5-dioxotriazolyl group, etc.) and $W_2$ represents a t-butyl group or an

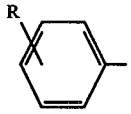

group wherein R represents an alkyl group having 1 to 20 carbon atoms (e.g., a methyl group, a pentadecyl group, etc.) or an alkoxy group having 1 to 20 carbon atoms (e.g., a methoxy group, a hexadecyloxy group, etc.). However, $W_2$ may represent a t-butyl group when $X_3$ is a cyclic amido group containing a 5- or 6-membered heterocyclic ring which may be condensed with a benzene ring. $W_1$ represents

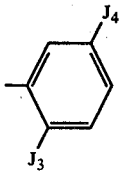

wherein $J_3$ represents a halogen atom or an alkoxy group having 1 to 20 carbon atoms, and $J_4$ represents a sulfo group, a carboxyl group, an acylamino group having 2 to 24 carbon atoms (e.g., α-(2,4-di-t-pentylphenoxy)butyramido, γ-(2,4-di-t-pentylphenoxy)-butyramido, etc.) or an alkoxycarbonyl group having 2 to 20 carbon atoms (e.g., a dodecyloxycarbonyl group, etc.). But $J_4$ may represent an acylamino group when $X_3$ is a cyclic amido group.

Examples of particularly preferred couplers having a high coupling rate reactivity include the following compounds. However, the present invention is not to be construed as being limited to those compounds.

(Cyan Couplers)

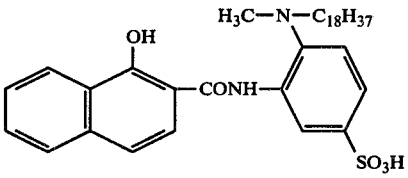

C-1

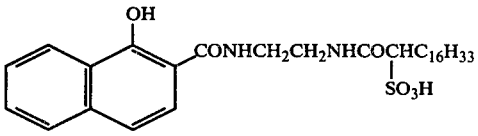

C-2

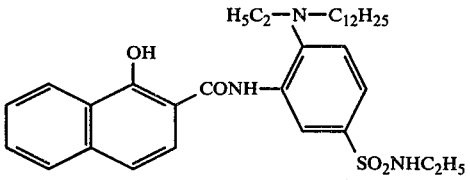

C-3

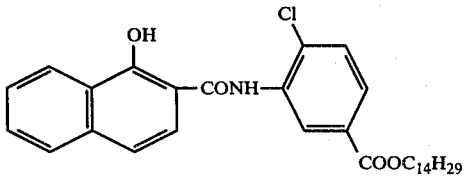

C-4

-continued
C-5
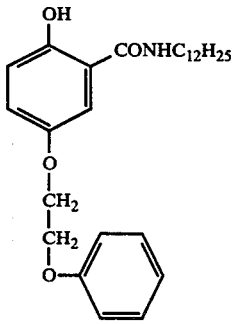
(Magenta Couplers)
M-1
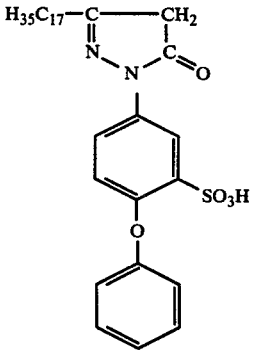
M-2
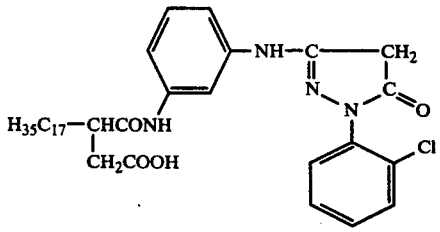
M-3
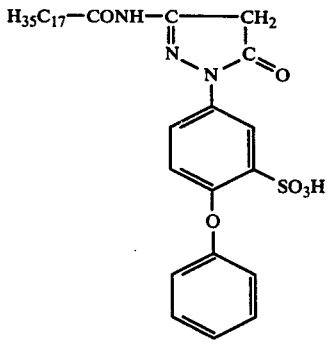
M-4
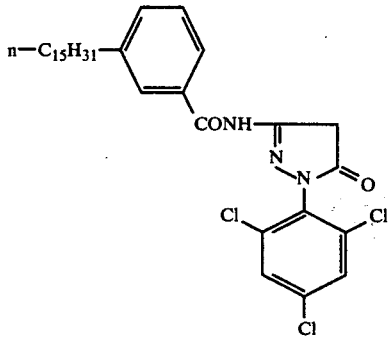

-continued
M-5
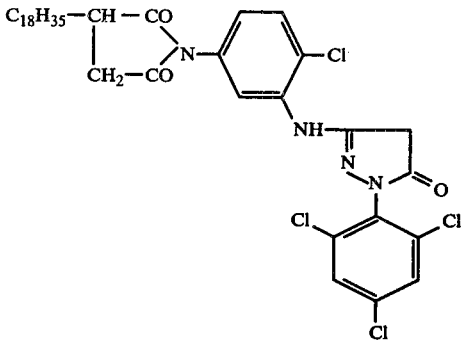
(Yellow Couplers)
Y-1
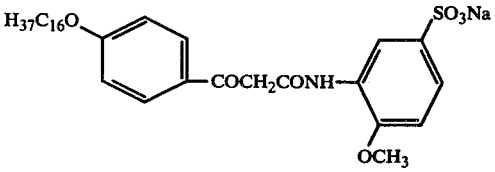
Y-2
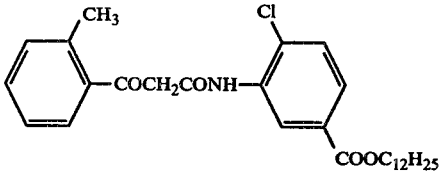
Y-3
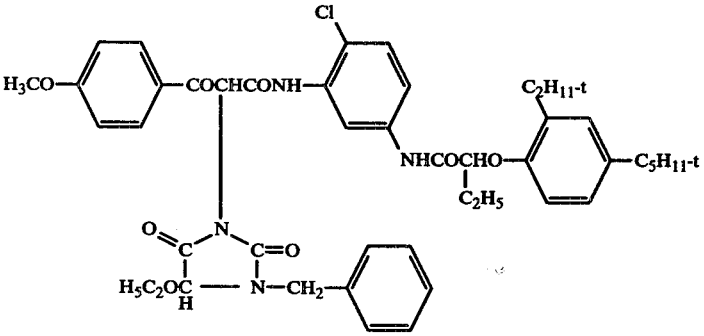
Y-4
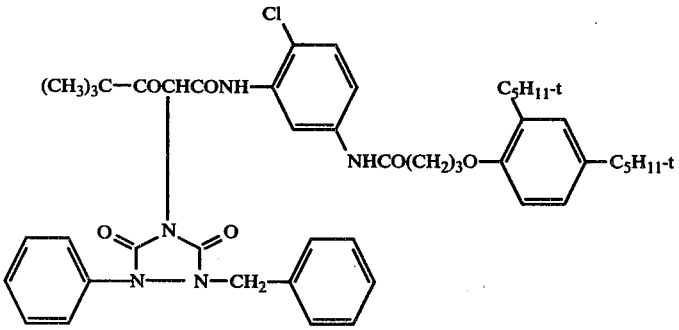
(Cyan Couplers)
(IV)
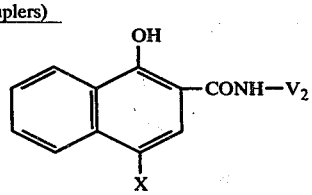
Preferred couplers having a low coupling rate reactivity are couplers having the following general formulae.

In the formula (IV), $V_2$ represents an alkyl group having 12 to 20 carbon atoms (e.g., dodecyl) or an aryloxyalkyl group having 7 to 24 carbon atoms (for example, a 3-(2,4-di-t-pentylphenoxy)propyl group or a 4-(2,4-di-t-pentylphenoxy)butyl group, etc.) and X represents a hydrogen atom or a halogen atom (e.g., chlorine, iodine, etc.).

(Magenta Couplers)

(V)

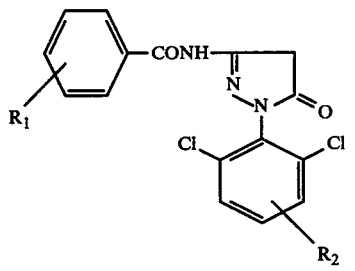

In the formula (V), $R_2$ represents a halogen atom (e.g., chlorine, etc.), an alkyl group having 1 to 4 carbon atoms or an alkoxy group having 1 to 4 carbon atoms, and $R_1$ represents an alkyl group having 1 to 20 carbon atoms (e.g., n-pentadecyl, etc.), an aryloxyalkylcarbonamido group having 2 to 20 carbon atoms (e.g. 2,4-di-t-pentylphenoxyacetamido, α-(2,4-di-t-pentylphenoxy)butyramido, etc.) or an alkylamido group having 2 to 20 carbon atoms (e.g., tetradecylamido, etc.).

(Yellow Couplers)

(VI)

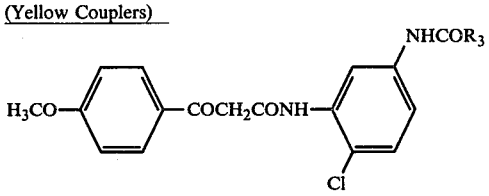

In the formula (VI), $R_3$ represents an alkyl group having 1 to 20 carbon atoms (e.g., heptadecyl, etc.) or an aryloxyalkyl group having 7 to 20 carbon atoms (e.g., 2,4-di-t-pentylphenoxymethyl, etc.).

Specific examples of particularly preferred couplers having a low coupling rate reactivity include the following compounds. However, the present invention is not to be construed as being limited th these compounds.

(Cyan Couplers)

C-6

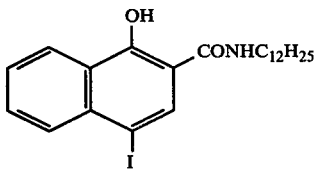

C-7

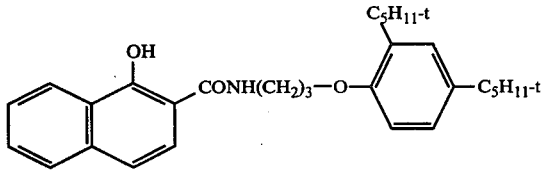

C-8

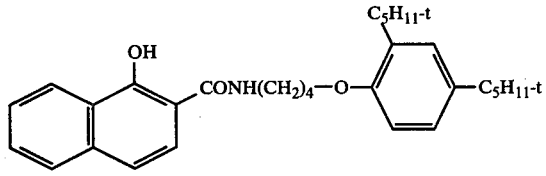

(Magenta Couplers)

M-6

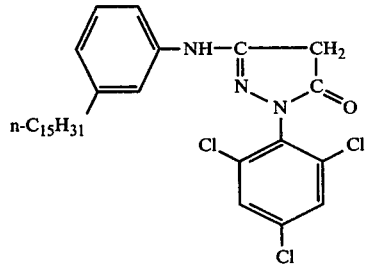

-continued

M-7

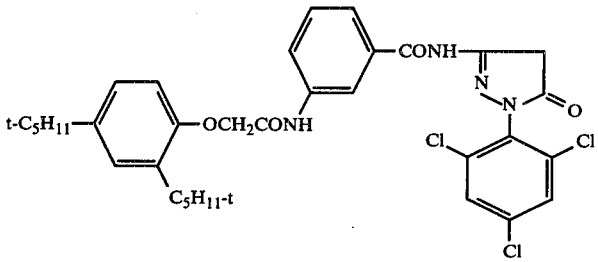

M-8

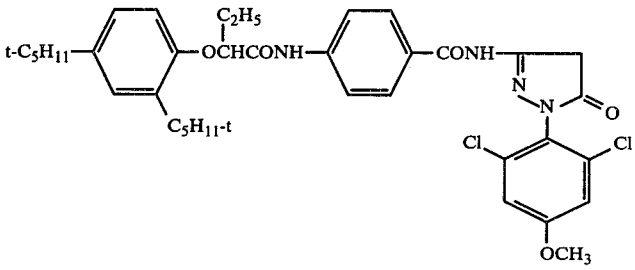

(Yellow Couplers)

Y-5

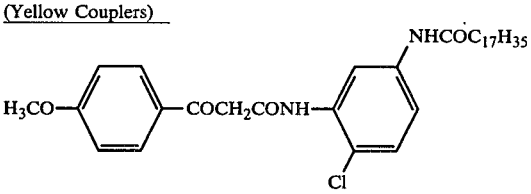

Y-6

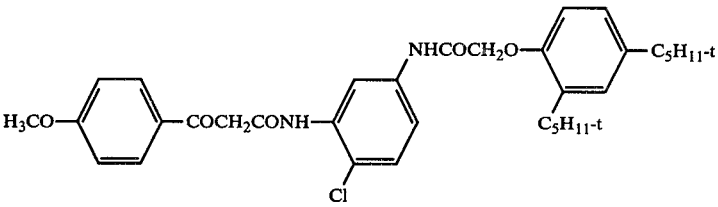

The DIR compounds which can be used in the present invention include DIR couplers, non-color forming DIR coupling compounds and DIR redox compounds.

Examples of the DIR couplers which can be used in the present invention include o-aminoazo type DIR couplers described in U.S. Pat. No. 3,148,062, thioether type DIR couplers described in U.S. Pat. No. 3,227,554, 2-benzotriazolyl type DIR couplers described in U.S. Pat. No. 3,617,291, 1-benzotriazolyl type DIR couplers described in German Patent Application (OLS) No. 2,414,006, Japanese Patent Applications Nos. 159,263/75 and 34,615/76, nitrogen-containing heterocyclic ring substituted acetate type DIR couplers described in Japanese Patent Application (OPI) No. 30,591/75 and Japanese Patent Application No. 159,255/75, 2-equivalent type DIR cyan couplers described in German Patent Application (OLS) 2,527,652 and Japanese Patent Applications Nos. 7,770/76 and 70,592/75 and malonic acid diamide type DIR couplers described in Japanese Patent Application No. 146,570/75.

Examples of the non-color forming DIR coupling compounds which can be used in the present invention include thioether type cyclic non-color forming DIR coupling compounds described in British Patent No. 1,423,588, German Patent Applications (OLS) Nos. 2,405,442, 2,523,705, 2,529,350 and 2,448,063 and U.S. Pat. No. 3,938,996, thioether type chain non-color forming DIR coupling compounds described in U.S. Pat. Nos. 3,632,345 and 3,928,041, benzotriazolyl type non-color forming DIR compounds described in Japanese Patent Application (OPI) 147,716/75 and Japanese Patent Applications Nos. 31,480/75 and 143,538/75 and picolinium type DIR coupling compounds described in Japanese Patent Application No. 147,091/74.

Examples of DIR redox compounds which can be used in the present invention include DIR hydroquinones described in U.S. Pat. No. 3,639,417, German Patent Application (OLS) No. 2,460,202 and U.S. Patent No. 3,297,445 and DIR redox type couplers described in Japanese Patent Application No. 133,693/75.

Preferred DIR compounds which can be used in the present invention are represented by the following general formulae (VII)–(X).

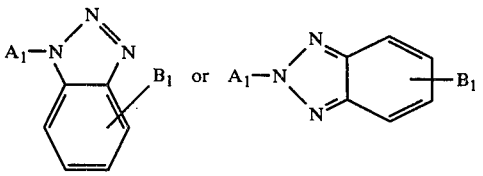

(VII)

wherein $A_1$ represents a yellow coupler residue, a magenta coupler residue, a cyan coupler residue, a malondiimide coupler residue, a malondiester coupler residue or an indanone coupling compound residue, and $B_1$ represents a bromine atom, an acylamino group, a benzothiazolinylideneamino group or an aralkyloxy group.

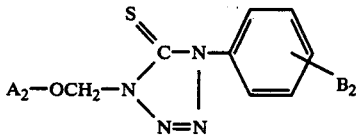

(VIII)

wherein $A_2$ represents a cyan coupler residue, and $B_2$ represents a halogen atom, a nitro group, an alkoxy group, an alkyl group, an amino group or an acylamino group.

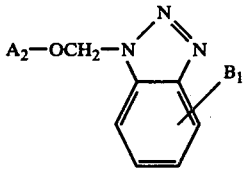

(IX)

wherein $A_2$ has the same meaning as in the general formula (VIII) and $B_1$ has the same meaning as in the general formula (VIII).

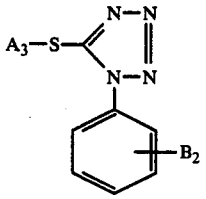

(X)

wherein $B_2$ has the same meaning as in the general formula (VIII) and $A_3$ represents a yellow coupler residue, a magenta coupler residue, a cyan coupler residue, a malondiimide coupler residue, a malondiester coupler residue, an indanone coupling compound residue, an α-(2-benzothia (or benzooxa)-acetanilide) type coupler residue or a hydroquinone residue.

Specific examples of particularly preferred development inhibitor releasing (DIR) compounds include the following compounds. However, the present invention is not to be construed as being limited to these compounds.

(DIR Yellow Couplers)

D-1

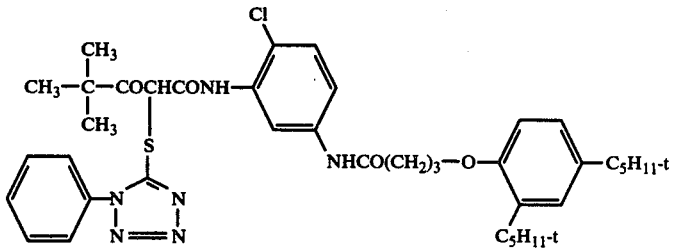

D-2

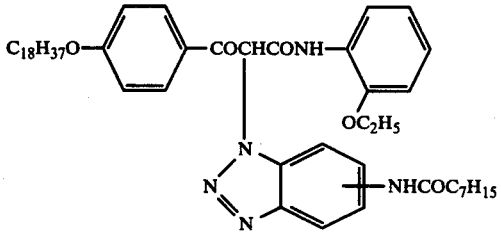

D-3

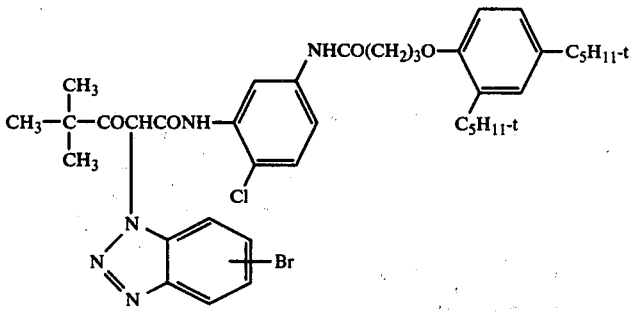

-continued
D-4
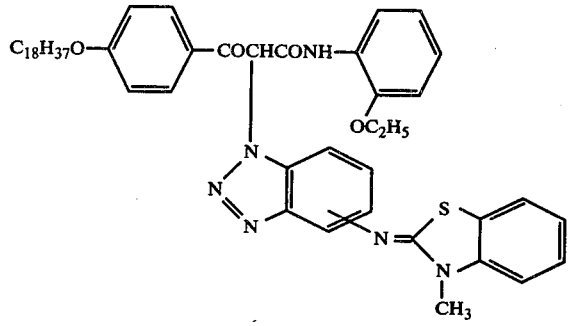
D-5
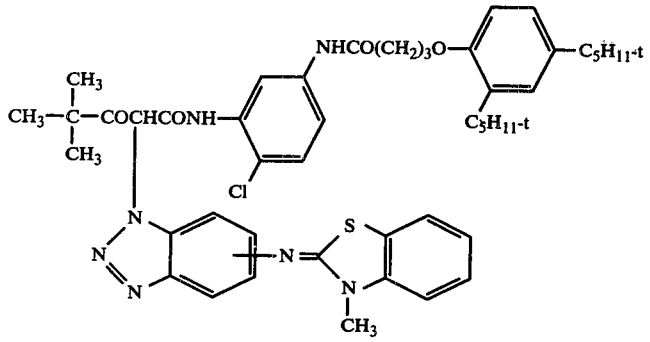
D-6
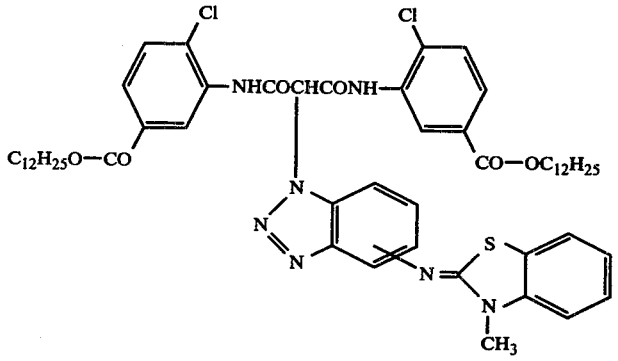
D-7
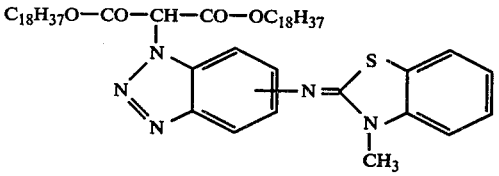
D-8
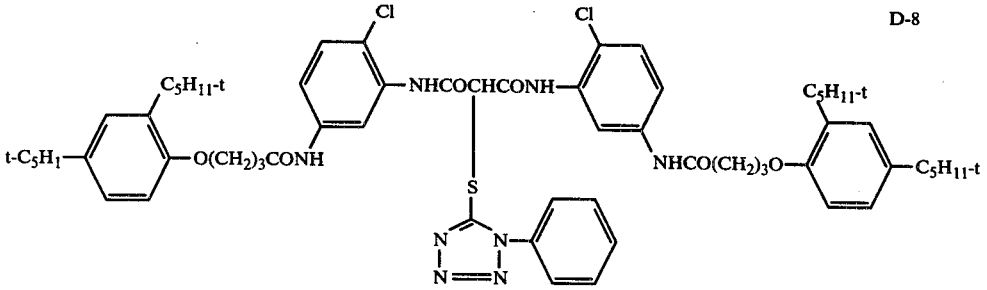

-continued
D-9
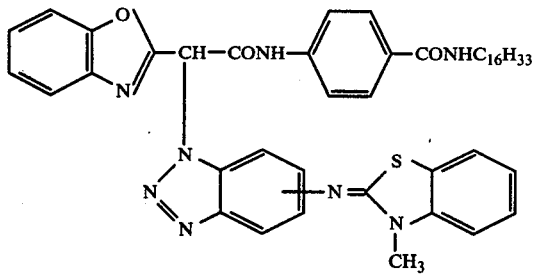
(DIR Magenta Couplers)
D-10
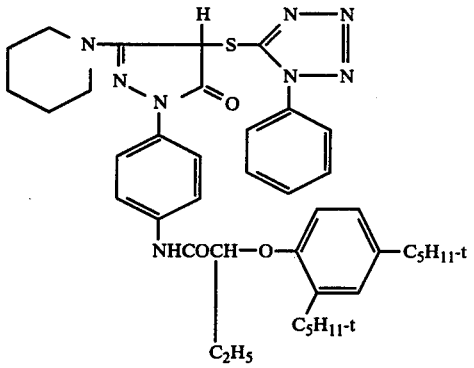
D-11
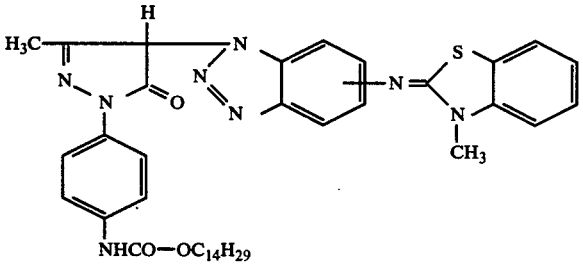
D-12
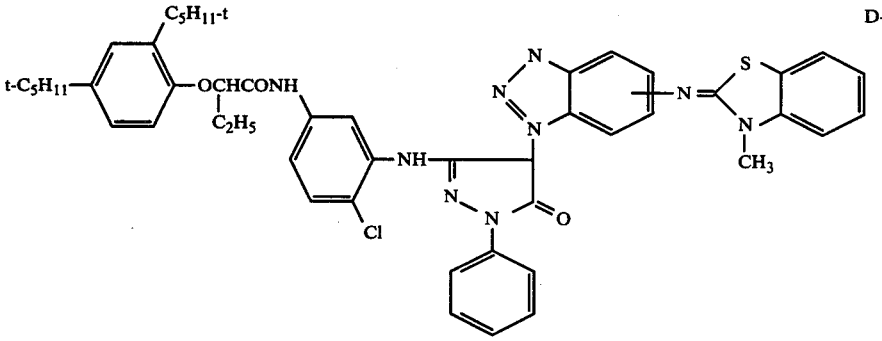
(DIR Cyan Couplers)
D-13
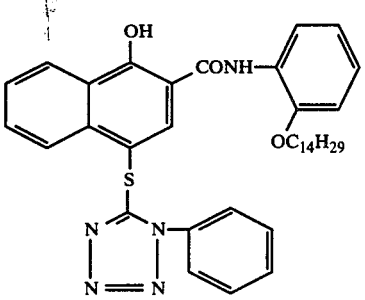

-continued
D-14
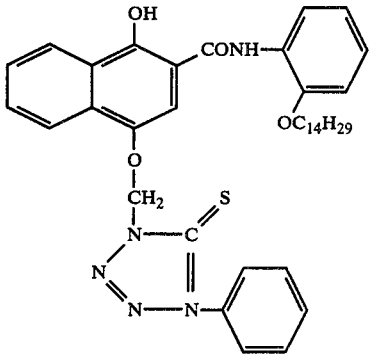
D-15
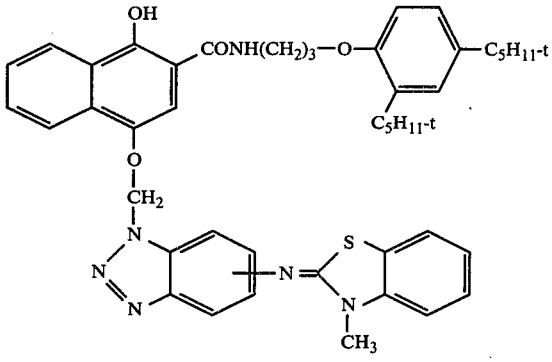
D-16
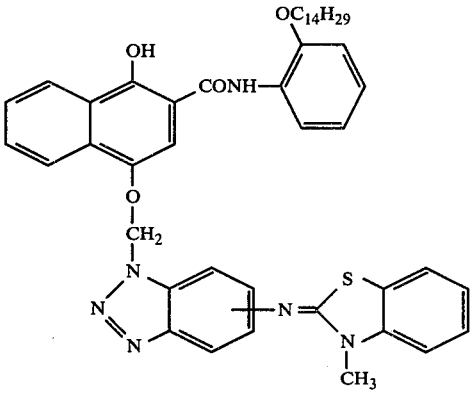
(Non-Color Forming DIR Coupling Compounds)
D-17
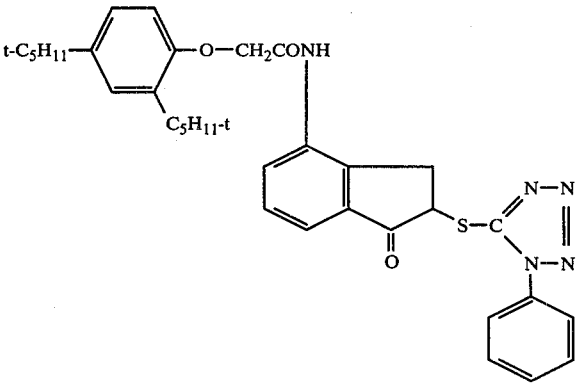

-continued
D-18
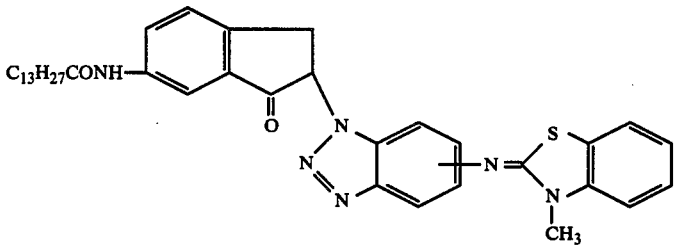
D-19
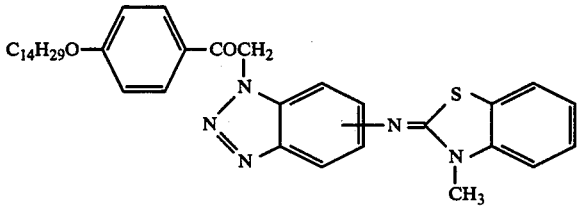
D-20
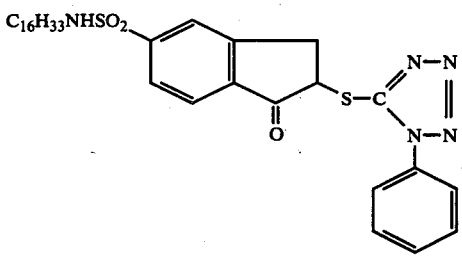
D-21
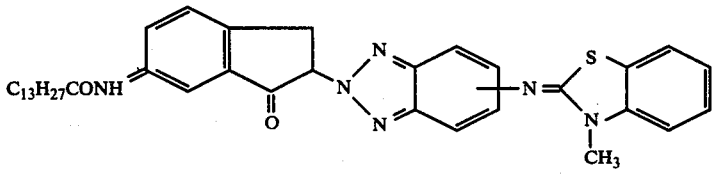
(DIR Redox Compounds)
D-22
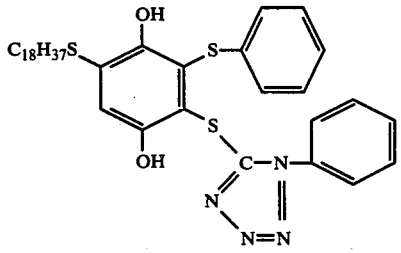
D-23
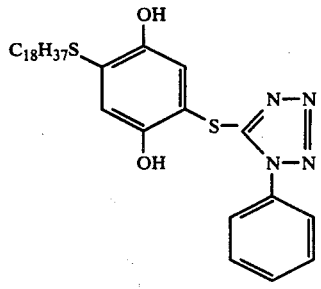

-continued

D-24

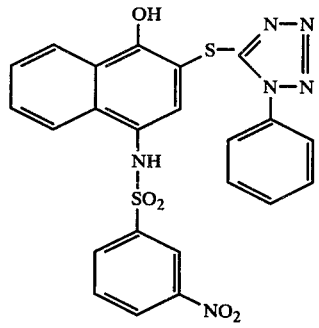

Examples of silver halides which can be employed in the emulsions used in the present invention include not only silver chloride and silver bromide but also mixed silver halides such as silver bromochloride, silver iodobromide or silver iodobromochloride. Preferred silver halides are silver iodobromide containing about 1 to about 12% by mol of silver iodide and particularly silver iodobromide containing 4 to 10% by mol of silver iodide. The silver halide grains may have any crystal form such as a cubic form, an octahedral form or a mixed crystal form thereof, etc. It is not necessary to use silver halides having a uniform grain size.

These silver halide grains can be produced using known conventional methods, for example, they can be produced using the so-called single or double jet process or a controlled double jet process.

These photographic emulsions are described in C. E. K. Mees and T. H. James, *The Theory of the Photographic Process,* 3rd Ed., Macmillan Co., New York (1967) and P. Grafkides, *Chimie Photographique,* Paul Montel Co., Paris (1957), etc., and they can be produced using various known methods such as an ammonia process, a neutral process or an acid process.

The above-described silver halide emulsions can be chemically sensitized using conventional methods. Suitable chemical sensitizing agents include gold compounds such as chloroaurates or gold trichloride, etc., as described in U.S. Pat. Nos. 2,399,083, 2,540,085 and 2,597,915, salts of noble metals such as platinum, palladium, iridium, rhodium or ruthenium as described in U.S. Pat. Nos. 2,448,060, 2,540,086, 2,566,245, 2,566,263 and 2,598,079, sulfur compounds which yield silver sulfide by reaction with silver salts, as described in U.S. Pat. Nos. 1,574,944, 2,410,689, 3,189,458 and 3,501,313, etc., and reducing materials such as stannous salts, amines and the like as described in U.S. Pat. Nos. 2,487,850, 2,518,698, 2,521,925, 2,521,926, 2,694,637, 2,983,610 and 3,201,254.

The photographic emulsions may be, if desired, spectrally sensitized or supersensitized using one or more cyanine dyes such an cyanine, merocyanine or carbocyanine dyes or using combinations of cyanine dyes and styryl dyes.

These dyes are well known. Suitable dyes for the blue-sensitive layer include those dyes described, for example, in U.S. Pat. Nos. 2,493,748, 2,519,001, 2,977,229, 3,480,434, 3,672,897 and 3,703,377. Suitable dyes for the green-sensitive layer are those dyes described, for example, in U.S. Pat. Nos. 2,688,545, 2,912,329, 3,397,060, 3,615,635 and 3,628,964, British Pat. No. 1,195,302, German Patent Applications (OLS) Nos. 3,030,326 and 2,121,780 and Japanese Patent Publications Nos. 4,936/68 and 14,030/69. Suitable dyes for the red-sensitive layer include those dyes described, for example, in Japanese Patent Publication No. 10,773/68, U.S. Pat. Nos. 3,511,664, 3,522,052, 3,527,641, 3,615,613, 3,615,632, 3,617,295, 3,635,721 and 3,694,217 and British Patents Nos. 1,137,580 and 1,216,203. The dyes can be suitably chosen depending on the wavelength range to be sensitized, the sensitivity desired, the purpose and use of the light-sensitive material, etc.

It is possible to add various kinds of compounds to the above-described photographic emulsions in order to prevent a deterioration of the sensitivity or an occurrence of fog during production, during storage or during the processing of the light-sensitive material. A large number of such compounds are known, such as 4-hydroxy-6-methyl-1,3,3a,7-tetrazaindene, 3-methylbenzothiazole, 1-phenyl-5-mercaptotetrazole and many other heterocyclic compounds, mercury compounds, mercapto compounds and metal salts, etc.

Some examples of these compounds capable of being used are described in not only C. E. K. Mees and T. H. James, *The Theory of the Photographic Process,* 3rd Edition, p. 344 to 349, Macmillan, New York (1966) and the original references cited therein but also in the following patents: U.S. Pat. Nos. 1,758,576, 2,110,178, 2,131,038, 2,173,628, 2,697,040, 2,304,962, 2,324,123, 2,394,198, 2,444,605–8, 2,566,245, 2,694,716, 2,697,099, 2,708,162, 2,728,663–5, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668 and 3,622,339 and British Pat. Nos. 893,428, 403,789, 1,173,609 and 1,200,188.

Suitable hydrophilic colloids which can be used as binders for the silver halides include gelatin, modified gelatin, colloidal albumin, casein, cellulose derivatives such as carboxymethyl cellulose or hydroxyethyl cellulose, etc., saccharide derivatives such as agar, sodium alginate or starch derivatives, etc., and synthetic hydrophilic colloids such as polyvinyl alcohol, poly-N-vinylpyrrolidone, polyacrylic acid copolymers, polyacrylamide, the derivatives thereof or the partially hydrolyzed products thereof, etc. If necessary, compatible mixtures of two or more of these colloids may be used.

Each layer of the photographic light-sensitive materials can be coated using various coating methods such as a dip coating method, an air knife coating method, a curtain coating method or an extrusion coating method using a hopper described in U.S. Pat. No. 2,681,294.

If desired, two or more layers may be coated at the same time using the methods described in U.S. Pat. Nos. 2,761,791, 3,508,947, 2,941,898 and 3,526,528, etc.

The photographic emulsions are coated on supports which do not undergo any marked dimensional changes during processings.

Typical supports include cellulose acetate films conventionally used for photographic light-sensitive materials, polystyrene films, polyethylene terephthalate films, polycarbonate films and laminates of these films, paper and coated paper or laminated paper prepared by applying baryta or hydrophobic polymers such as polyethylene or polypropylene, etc., thereto.

These supports may be transparent, depending on the purpose of the light-sensitive material. Further, the supports may be colored by addition thereto of dyes or pigments, as described in *J. SMPTE* 67, 296 (1958), etc.

When the adhesive strength between the support and the photographic emulsion layer is insufficient, a subbing layer which is adhesive to both of the support and the emulsion layer is provided on the support. In order to further improve the adhesive property, the surface of the support may be subjected to a previous treatment such as a corona discharge treatment, an ultraviolet light treatment or a flame treatment, etc.

In order to obtain dye images on the color photographic light-sensitive materials of the present invention, it is necessary to carry out development after imagewise exposure of the light-sensitive materials to light. Conventional exposure techniques can be used and a suitable exposure amount is, e.g., about 10 CMS.

The development processing comprises essentially the steps of color development, bleaching and fixing. In this case, each step may be conducted separately or two or more of these steps may be carried out in one processing using a processing solution having the capability of accomplishing each of the steps. For example, a mono-bath bleach-fix solution is one such example. Further, each step may be carried out, if desired, by dividing the step into two or more processings. Further, a combination of color development, a first fixing and a bleach-fixing can be carried out. The development processing may be combined with, if necessary, various processings such as a prehardening, a neutralizing, a first development (black-and-white development) and a water wash, etc., in addition to the above-described processings. The processing temperature is set in a suitable range depending upon each processing of the light-sensitive materials and it is sometimes lower than about 18° C. but often higher than about 18° C. The temperature often used ranges from about 20° C. to about 60° C., and, recently, particularly ranges from 30° C. to 60° C. Although for continuous processing to be carried out it is preferred for the temperature in each processing step to be the same, but this is not always necessary.

Preferred color developing solutions are alkaline aqueous solutions containing generally a developing agent having a pH of about 8 or more, and preferably a pH of 9 to 12. Preferred examples of developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline and the salts thereof (for example, sulfates, hydrochlorides, sulfites and p-toluenesulfonates, etc.). In addition, those developing agents described in U.S. Pat. Nos. 2,193,015 and 2,592,364, Japanese Patent Application (OPI) 64,933/73 and L. F. A. Mason, *Photographic Processing Chemistry,* pages 226–229, Focal Press, London (1966) can be used. Further, the above-described compounds may be used together with 3-pyrazolidones. If desired, various kinds of additives may be added to the color developing solution.

Examples of suitable additives include alkali agents (for example, alkali metal or ammonium hydroxides, carbonates or phosphates), pH controlling or buffer agents (for example, weak acids such as acetic acid or boric acid, and the salts thereof), development accelerating agents (pyridinium compounds or the cationic compounds described in U.S. Pat. Nos. 2,648,604 and 3,671,247, potassium nitrate or sodium nitrate, polyethylene glycol condensates and derivatives thereof described in U.S. Pat. Nos. 2,533,990, 2,577,127 and 2,950,970, nonionic compounds such as polythioethers represented by the compounds described in British Patent Nos. 1,020,033 and 1,020,032, polymers having sulfite ester groups such as the compounds described in U.S. Pat. No. 3,068,097, organic amines such as pyridine or ethanolamine, etc., benzyl alcohol or hydrazines, etc.), anti-fogging agents (for example, alkali metal bromides, alkali metal iodides, nitrobenzimidazoles described in U.S. Pat. Nos. 2,496,940 and 2,656,271, mercaptobenzimidazole, 5-methylbenzotriazole, 1-phenyl-5-mercaptotetrazole, the compounds described in U.S. Pat. Nos. 3,113,864, 3,342,596, 3,295,976, 3,615,522 and 3,597,199, etc., the thiosulfonyl compounds described in British Patent No. 972,211, phenazine-N-oxides described in Japanese Patent Publication 41,675/71, and anti-fogging agents described in *Kagaku Shashin Binran,* Vol. 2, pages 29–47, Dec. 20, 1959), stain- or sludge-preventing agents described in U.S. Pat. Nos. 3,161,513 and 3,161,514 and British Patent Nos. 1,030,442, 1,144,481 and 1,251,558, agents for accelerating interimage effects described in U.S. Pat. No. 3,536,487 and preservatives (for example, sulfites, acid sulfites, hydroxylamine hydrochloride, formsulfite and alkanolamine sulfite addition products, etc.).

The light-sensitive materials of the present invention are subjected to a bleach processing in a conventional manner after color development has been conducted. This processing may be carried out simultaneously with the fixing or may be carried out separately from the fixing.

If desired, a fixing agent may be added to the bleach processing solution to make a bleach-fix solution. Many compounds can be used as bleaching agents. For example, ferricyanates, bichromates, water soluble cobalt (II) salts, water soluble copper (II) salts, water soluble quinones, nitrosophenol, polyvalent metal compounds of iron (III), cobalt (III) or copper (II) and particularly complex salts of these polyvalent metal cations and organic acids such as metal complex salts of aminopolycarboxylic acids such as ethylenediaminetetraacetic acid, nitrilotriacetic acid, iminodiacetic acid or N-hydroxyethyl ethylenediaminetriacetic acid, etc., malonic acid, tartaric acid, malic acid, diglycolic acid or dithioglycolic acid, etc., or copper complex salt of 2,6-di-picolic acid, etc., peracids such as alkyl peracids, persulfates, permanganates or hydrogen peroxide, etc., hypochlorites, chlorine, bromine or bleaching powder, etc., which may be used individually or as a combination of two or more thereof can be employed.

To this processing solution, it is possible to add the bleach accelerating agents described in U.S. Pat. Nos. 3,042,520, and 3,241,966 and Japanese Patent Publications 8,506/70 and 8,836/70 and various other additives.

Preferred embodiments of the present invention are as follows. In silver halide multilayer color light-sensitive materials in which a red-sensitive silver halide emulsion layer, a green-sensitive silver halide emulsion layer and a blue-sensitive silver halide emulsion layer are coated in this order on a support, (1) the red-sensitive silver halide emulsion layer, the green-sensitive silver halide emulsion layer and the blue-sensitive silver halide emulsion layer each comprises three unit emulsion layers wherein the sensitivity of each unit emulsion layer decreases in the order of the upper unit emulsion layer, the middle unit emulsion layer and the lower unit emulsion layer, (2) the red-sensitive silver halide emulsion layer and the green-sensitive silver halide emulsion layer each comprises three unit emulsion layers wherein the sensitivity of each unit emulsion layer decreases in order of the upper unit emulsion layer, the middle unit emulsion layer and the lower unit emulsion layer, and the blue-sensitive silver halide emulsion layer comprises two unit emulsion layers wherein the sensitivity of each unit emulsion layer decreases in order of the upper unit emulsion layer and the lower unit emulsion layer, or (3) the red-sensitive silver halide emulsion layer comprises an upper unit emulsion layer having a high sensitivity and a lower unit emulsion layer having a low sensitivity, the green-sensitive silver halide emulsion layer comprises three unit emulsion layers comprising an upper unit emulsion layer having a high sensitivity, a middle unit emulsion layer having an intermediate sensitivity and lower unit emulsion layer having a low sensitivity, and the blue-sensitive silver halide emulsion layer comprises an upper unit emulsion layer having a high sensitivity and a lower unit emulsion layer having a low sensitivity.

In silver halide multilayer color light-sensitive materials having the above-described preferred layer structure, at least the middle unit emulsion layer of the three unit emulsion layers comprising the upper unit emulsion layer, the middle unit emulsion layer and the lower unit emulsion layer contains a DIR compound in an amount of about 0.01 to about 40% by mol of the total of the couplers in the middle unit emulsion layer.

With the silver halide multilayer color light-sensitive materials of the present invention, an improved sensitivity required for high speed photographic sensitive materials and color images with a fine granularity can be attained.

Particularly, it is possible to improve the sharpness without curling occurring.

The invention is described in greater detail by reference to the following examples. Unless otherwise indicated herein, all parts, percents, ratios and the like are by weight.

EXAMPLE 1

A green-sensitive silver halide emulsion was prepared as follows.

1 - a: Preparation of a silver halide emulsion for the unit emulsion layer having a low sensitivity:

A silver iodobromide emulsion containing 6% by mol of iodine (average grain size: 0.6μ, which contained 100 g of silver halide and 70 g of gelatin per kg of the emulsion) was prepared by a conventional method. To 1 kg of this emulsion, 200 cc of a 0.1% solution of 3,3'-di-(2-sulfoethyl)-9-ethylbenzoxacarbocyanine pyridinium salt in methanol was added as a green-sensitive color sensitizing agent, and then 20 cc of an aqueous solution of 5% by weight of 5-methyl-7-hydroxy-2,3,4-triazaindolizine was added thereto. Further, magenta coupler Emulsions (1) and (2) having the following compositions were added as described in Table 1 below. In addition, 50 cc of an aqueous solution of 2% by weight of 2-hydroxy-4,6-dichlorotriazine sodium salt was added as a gelatin hardening agent to produce an emulsion for the unit emulsion layer having a low sensitivity. This emulsion is designated (1A).

| Emulsion (1) : | | |
|---|---|---|
| (1) | Gelatin (10% by wt. aq. soln.) | 1,000 g |
| (2) | Sodium p-Dodecylbenzenesulfonate | 5 g |
| | Tricresylphosphate | 65 cc |
| | Magenta Coupler (M - 7) | 63 g |
| | Ethyl Acetate | 110 cc |

After the mixture (2) above was dissolved at 55° C., it was added to (1) which was previously heated to 55° C. The resulting mixture was emulsified using a colloid mill.

Magenta Coupler (M - 7):
1-(2,4,6-Trichlorophenyl)-3-[3-(2,4-di-t-pentylphenoxyacetamido)benzamido]-5-pyrazolone

| Emulsion (2) : | | |
|---|---|---|
| (1) | Gelatin (10% by wt. aq. soln.) | 1,000 g |
| (2) | Sodium p-Dodecylbenzenesulfonate | 5 g |
| | Tricresylphosphate | 65 cc |
| | Magenta Coupler (M - 7) | 6 g |
| | DIR Magenta Coupler (D - 10) | 60 g |
| | Ethyl Acetate | 110 cc |

Emulsification was carried out using the same procedure as the case of Emulsion (1).

DIR Magenta Coupler (D - 10):
1-{4-[α-(2,4-Di-t-pentylphenoxy)butyramido]phenyl}-3-(1-pyrrodinyl)-4-(1-phenyltetrazolyl-5-thio)-5-pyrazolone 1 - b: Preparation of a silver halide emulsion for the unit emulsion layer having a middle sensitivity:

A silver iodobromide emulsion containing 5% by mol of iodine (average grain size: 0.9μ, which contained 100 g of silver halide and 70 g of gelatin per kg of the emulsion) was produced. To 1 kg of this emulsion, 150 cc of a solution of the green-sensitive color sensitizing agent described in 1 - a in methanol was added, and then 20 cc of an aqueous solution of 5% by weight of 5-methyl-7-hydroxy-2,3,4-triazaindolizine was added thereto. Further, Emulsions (1) and (2) were added as described in Table 1 below. In addition, 50 cc of an aqueous solution of 2% by weight of 2-hydroxy-4,6-dichlorotriazine sodium salt was added as a gelatin hardening agent to produce an emulsion for the unit emulsion layer having a middle sensitivity. This emulsion is designated (1B).

1 - c: Preparation of a silver halide emulsion for the unit emulsion layer having a high sensitivity:

A silver iodobromide emulsion containing 6% by mol of iodine (average grain size: 1.1μ, with the amount of grains having a grain size larger than 1.0μ being 50% by weight of the total grains and 8.9% of the total grains having a grain size of larger than 2.0μ, which contained 100 g of silver halide and 70 g of gelatin per kg of the emulsion) was produced. To 1 kg of this emulsion, 80 cc of a solution of the green-sensitive color sensitizing agent described in 1 - a in methanol was added, and then 20 cc of an aqueous solution of 5% by weight of 5-methyl-7-hydroxy-2,3,4-triazaindolizine was added. Further, Emulsions (1) and (2) were added as described in Table 1 below. In addition, 50 cc of an aqueous solution of 2% by weight of 2-hydroxy-4,6-dichlorotriazine sodium salt was added as a gelatin hardening agent to produce an emulsion for the unit emulsion layer having a high sensitivity. This emulsion is designated (1C).

Using the emulsions prepared as described above, Films A to H were prepared. Namely, Emulsions (1A), (1B), (1C) and a protective layer (gelatin, dried film thickness: 1μ) were coated in this order on a cellulose triacetate support in the amounts (as silver) shown in Table 2 below.

1 - d: Preparation of a silver halide emulsion for the unit emulsion layer having a low sensitivity for a two unit emulsion layer structure:

An emulsion was prepared in the same manner as in 1 - a except that an emulsion prepared by mixing 600 g of the silver iodobromide emulsion described in 1 - a and 400 g of the silver iodobromide emulsion described in 1 - b was used as described in Table 1 below. This emulsion is designated (1D).

To a cellulose triacetate support, Emulsions (1D), (1C) and a protective layer (gelatin, dried film thickness: 1μ) were coated in this order in the amounts (as silver) shown in Table 2 below. The resulting film is designated Film I.

These Films A to I were exposed to light in an amount of 10 CMS through a green filter and subjected to the following processing.

| Processing Step | Temperature (° C) | Time (minutes) |
|---|---|---|
| Color Development | 38 | 3 |
| Stopping | " | 1 |
| Water Wash | " | 1 |
| Bleaching | " | 2 |
| Water Wash | " | 1 |
| Fixing | " | 2 |
| Water Wash | " | 1 |
| Stabilizing Bath | " | 1 |

The processing solutions used each had the following composition.

| | |
|---|---|
| **Color Developing Solution** | |
| Sodium Hydroxide | 2 g |
| Sodium Sulfate | 2 g |
| Potassium Bromide | 0.4 g |
| Sodium Chloride | 1 g |
| Borax | 4 g |
| Hydroxylamine Sulfate | 2 g |
| Di-sodium Ethylenediaminetetraacetate (monohydrate) | 2 g |
| 4-Amino-3-methyl-N-ethyl-N-(β-hydroxyethyl)aniline Monosulfate | 4 g |
| Water to make | 1 l |
| **Stoping Solution** | |
| Sodium Thiosulfate | 10 g |
| Ammonium Thiosulfate (70% aq. soln.) | 30 ml |
| Acetic Acid | 30 ml |
| Sodium Acetate | 5 g |
| Potassium Alum | 15 g |
| Water to make | 1 l |
| **Bleaching Solution** | |
| Sodium Ethylenediaminetetraacetate Iron (III) (dihydrate) | 100 g |
| Potassium Bromide | 50 g |
| Ammonium Nitrate | 50 g |
| Boric Acid | 5 g |
| Aqueous Ammonia Solution | to adjust a pH to 5.0 |
| Water to make | 1 l |
| **Fixing Solution** | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 l |
| **Stabilizing Bath** | |
| Boric Acid | 5 g |
| Sodium Citrate | 5 g |
| Sodium Metaborate (tetrahydrate) | 3 g |
| Potassium Alum | 15 g |
| Water to make | 1 l |

The compositions of the silver halide emulsion layers in the films are shown in Table 1 and the silver contents and granularity are shown in Table 2.

When the emulsions were coated according to the silver content shown in Table 2, fogging and sensitivity in Films A to I were substantially equal to each other and the characteristic curves thereof were nearly straight.

TABLE 1

| Film | Sensitive Layer Having Low Sensitivity for Two-Layer Structure | | Sensitive Layer Having Low Sensitivity | | Sensitive Layer Having Middle Sensitivity | | Sensitive Layer Having High Sensitivity | | Sensitive Layer Containing DIR Coupler |
|---|---|---|---|---|---|---|---|---|---|
| | Emulsion (1) (g) | Emulsion (2) (g) | Emulsion (1) (g) | Emulsion (2) (g) | Emulsion (1) (g) | Emulsion (2) (g) | Emulsion (1) (g) | Emulsion (2) (g) | |
| A | — | — | 400 | — | 300 | — | 200 | — | Absent |
| B | — | — | 380 | 20 | 300 | — | 200 | — | Low |
| C | — | — | 400 | — | 285 | 15 | 200 | — | Middle |
| D | — | — | 400 | — | 300 | — | 190 | 10 | High |
| E | — | — | 380 | 20 | 285 | 15 | 200 | — | Low, Middle |
| F | — | — | 380 | 20 | 300 | — | 190 | 10 | Low, Middle |
| G | — | — | 400 | — | 285 | 15 | 190 | 10 | Middle, High |
| H | — | — | 380 | 20 | 285 | 15 | 190 | 10 | Low, Middle, High |
| I | 380 | 20 | — | — | — | — | 200 | — | Low |

TABLE 2

| Film | Sensitive Layer Having Low Sensitivity for Two-Layer Structure | Sensitive Layer Having Low Sensitivity | Sensitive Layer Having Middle Sensitivity | Sensitive Layer Having High Sensitivity | Granularity (R.M.S.) (at D = 0.6) |
|---|---|---|---|---|---|
| A | — | 10 | 8 | 12 | 0.080 |
| B | — | 12 | 8 | 12 | 0.075 |
| C | — | 10 | 10 | 12 | 0.050 |
| D | — | 10 | 8 | 20 | 0.075 |
| E | — | 12 | 10 | 12 | 0.045 |
| F | — | 12 | 8 | 20 | 0.070 |

TABLE 2-continued

| Film | Sensitive Layer Having Low Sensitivity for Two-Layer Structure | Sensitive Layer Having Low Sensitivity | Sensitive Layer Having Middle Sensitivity | Sensitive Layer Having High Sensitivity | Granularity (R.M.S.) (at D = 0.6) |
|---|---|---|---|---|---|
| G | — | 10 | 10 | 20 | 0.045 |
| H | — | 12 | 10 | 20 | 0.040 |
| I | 22 | — | — | 12 | 0.085 |

As is clear from the results set forth in Table 1 and Table 2 above, in Films C, E, G and H which included the DIR coupler (5% by mol based on the total coupler) in the unit emulsion layer having a middle sensitivity, the granularity was remarkably improved. Further, granularity in Films C and E was clearly excellent as compared to Film I which included the DIR coupler in only the low speed layer in the two-layer structure.

EXAMPLE 2

A red-sensitive emulsion layer was prepared as follows.

2 - a: Preparation of silver halide emulsion for the unit emulsion layer having a low sensitivity:

A silver iodobromide emulsion containing 6% by mol of iodine (average grain size: 0.6μ, which contained 100 g of silver halide and 70 g of gelatin per kg of the emulsion) was produced. To 1 kg of this emulsion, 180 cc of a 0.1% solution of anhydro-5,5'-dichloro-9-ethyl-3,3'-di-(3-sulfopropyl)thiacarbocyanine hydroxide pyridinium salt in methanol was added as a red-sensitive color sensitizing agent, and then 20 cc of an aqueous solution of 5% by weight of 5-methyl-7-hydroxy-2,3,4-triazaindolizine, 330 g of cyan coupler Emulsion (3) having the following composition and 20 g of the cyan coupler Emulsion (4) having the following composition were added thereto. Further, 50 cc of an aqueous solution of 2% by weight of 2-hydroxy-4,6-dichlorotriazine sodium salt was added as a gelatin hardening agent to produce an emulsion for the unit emulsion layer having a low sensitivity. This emulsion is designated (2A).

| Emulsion (3) : | | |
|---|---|---|
| (1) | Gelatin (10% by wt. aq. soln.) | 1,000 g |
| (2) | Sodium p-Dodecylbenzenesulfonate | 5 g |
| | Tricresylphosphate | 60 cc |
| | Cyan Coupler (C - 7) | 70 g |
| | Ethyl Acetate | 100 cc |

After the mixture (2) was dissolved at 55° C., it was added to (1) which was previously heated to 55° C. The resulting mixture was emulsified using a colloid mill.

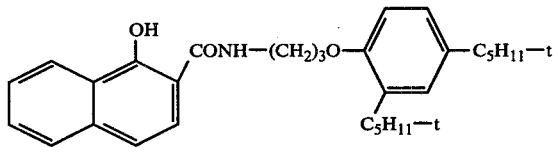

| Emulsion (4) : | | |
|---|---|---|
| (1) | Gelatin (10% by wt. aq. soln.) | 1,000 g |
| (2) | Sodium p-Dodecylbenzenesulfonate | 5 g |
| | Tricresyl Phosphate | 60 cc |
| | Cyan Coupler (C - 7) | 6 g |
| | DIR Cyan Coupler (D - 13) | 64 g |
| | Ethyl Acetate | 100 cc |

Emulsification was carried out using the same procedures as the case of Emulsion (1).

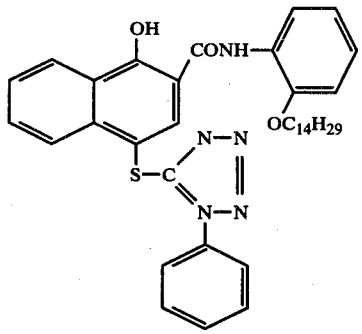

2 - b: Preparation of a silver halide emulsion for the unit emulsion layer having a middle sensitivity:

The procedures in 1 - a above were repeated with the following modifications.

| | |
|---|---|
| Average Grain Size of Silver Halide | 0.9 μ |
| Amount of Red-Sensitive Color Sensitizing Agent | 140 cc |
| Amount of Emulsion Added | Emulsion (3) : 240 g<br>Emulsion (4) : 10 g |

This emulsion is designated (2B).

2 - c: Preparation of a silver halide emulsion for the unit emulsion layer having a high sensitivity:

The procedures in 1 - a above were repeated with the following modifications.

| | |
|---|---|
| Average Grain Size of Silver Halide | 1.1μ (but the amount of grains having a grain size of more than 1.0μ was 50% by weight of the total grains and 8.9% of the whole grains had a particle size of 2.0μ or more) |
| Amount of Red-Sensitive Color Sensitizing Agent | 100 cc |
| Amount of Emulsion Added | Emulsion (3): 150 g |

This emulsion is designated (2C).

A green-sensitive emulsion layer was prepared as follows.

3 - a: Preparation of a silver halide emulsion for the unit emulsion layer having a low sensitivity:

380 g of Emulsion (1) and 20 g of Emulsion (2) were added as in the case of (1A) of Example 1 and is designated (3A).

3 - b: Preparation of a silver halide emulsion for the unit emulsion layer having a middle sensitivity:

285 g of Emulsion (1) and 15 g of Emulsion (2) were added as in the case of (1A) of Example 1 and is designated (3B).

3 - c: Preparation of a silver halide emulsion for the unit emulsion layer having a high sensitivity:

200 g of Emulsion (1) was added as in the case of (1A) of Example 1 and is designated (3C).

A blue-sensitive emulsion layer was prepared as follows.

4 - a: Preparation of a silver halide emulsion for the unit emulsion layer having a low sensitivity - (1):

A silver iodobromide emulsion containing 5% by mol of iodine (average grain size: 0.6μ, which contained 100 g of silver halide and 70 g of gelatin per kg of the emulsion) was prepared. To 1 kg of this emulsion, 20 cc of an aqueous solution of 5% by weight of 5-methyl-7-hydroxy-2,3,4-triazaindolizine and 600 g of the yellow coupler Emulsion (5) having the following composition were added. Further, 500 cc of an aqueous solution of 2% by weight of 2-hydroxy-4,6-dichlorotriazine sodium salt was added as a gelatin hardening agent to produce an emulsion for the unit emulsion layer having a low sensitivity. This emulsion is designated (4A).

| Emulsion (5): | |
|---|---|
| (1) Gelatin (10% by wt. aq. soln.) | 1,000 g |
| (2) Sodium p-Dodecylbenzene Sulfonate | 5 g |
| Tricresyl Phosphate | 80 cc |
| Yellow Coupler (Y - 5) | 100 g |
| Ethyl Acetate | 120 cc |

Emulsification was carried out in the same manner as in the case of Emulsion (3).

4 - b: Preparation of a silver halide emulsion for the unit emulsion layer having a low sensitivity - (2):

The procedures of 4 - a were repeated with the following modifications. The emulsion was prepared in the same manner as in (4A) except that 570 g of Emulsion (5) and 30 g of Emulsion (6) were used. This emulsion is designated (4B).

| Emulsion (6): | |
|---|---|
| (1) Gelatin (10% by wt. aq. soln.) | 1,000 g |
| (2) Sodium p-Dodecylbenzene Sulfonate | 5 g |
| Tricresyl Phosphate | 80 g |
| Yellow Coupler (Y - 5) | 10 g |
| DIR Coupler (D - 1) | 90 g |
| Ethyl Acetate | 120 cc |

Emulsification was carried out by the same procedures as in the case of Emulsion (3).

4 - c: Preparation of silver halide emulsion for the unit emulsion layer having a middle sensitivity - (1):

The procedures in 4 - a were repeated with the following modification.

| | |
|---|---|
| Average Grain Size of Silver Halide | 0.9μ |
| Amount of Emulsion Added | Emulsion (5): 400 g |

This emulsion is designated (4C).

4 - d: Preparation of a silver halide emulsion for the unit emulsion layer having a middle sensitivity - (2):

The procedures in 4 - a were repeated with the following modifications.

| | |
|---|---|
| Average Grain Size of Silver Halide | 0.9μ |
| Amount of Emulsion Added | Emulsion (5): 380 g<br>Emulsion (6): 20 g |

This emulsion is designated (4D).

4 - e: Preparation of a silver halide emulsion for the unit emulsion layer having a high sensitivity - (1):

The procedures of 4 - a were repeated with the following modifications.

| | |
|---|---|
| Average Grain Size of Silver Halide | 1.1μ (but the amount of grains having a grain size of more than 1.0μ was 50% by weight of the total grains and 8.9% of the total grains had a grains size of 2.0μ or more) |
| Amount of Emulsion Added | Emulsion (5): 200 g |

This emulsion is designated (4E).

4 - f: Preparation of a silver halide emulsion for the unit emulsion layer having a high sensitivity - (2):

The procedures of 4 - a were repeated with the following modifications.

| | |
|---|---|
| Average Grain Size of Silver Halide | 1.1μ (but the amount of grains having a grain size of more than 1.0μ was 50% by weight of the total grains and 8.9% of the total grains had a grain size of 2.0μ or more) |
| Amount of Emulsion Added | Emulsion (7): 200 g |

This emulsion is designated (4F).

| Emulsion (7): | |
|---|---|
| (1) Gelatin (10% by wt. aq. soln.) | 1,000 g |
| (2) Sodium Dodecylbenzene Sulfonate | 5 g |
| Tricresyl Phosphate | 80 cc |
| Yellow Coupler (Y - 3) | 100 g |
| Ethyl Acetate | 120 cc |

Emulsification was carried out using the same procedures as in the case of Emulsion (3).

To a cellulose triacetate support, emulsion layers were coated so as to have the silver content as shown in Table 3 below. Coating was carried out in the order shown in Table 3 below.

TABLE 3

| | Film C | | Film B | | Film A | |
|---|---|---|---|---|---|---|
| Layer | Emulsion | Silver Content ($mg/dm^2$) | Emulsion | Silver Content ($mg/dm^2$) | Emulsion | Silver Content ($mg/dm^2$) |
| a | (2A) | 10 | Same as Film C | Same as Film C | Same as Film C | Same as Film C |
| b | (2B) | 8 | " | " | " | " |
| c | (2C) | 12 | " | " | " | " |
| d | Gelatin intermediate layer dry thickness:1.0μ) | — | " | " | " | " |
| e | (3A) | 12 | " | " | " | " |
| f | (3B) | 10 | " | " | " | " |

TABLE 3-continued

| Layer | Film C Emulsion | Film C Silver Content (mg/dm$^2$) | Film B Emulsion | Film B Silver Content (mg/dm$^2$) | Film A Emulsion | Film A Silver Content (mg/dm$^2$) |
|---|---|---|---|---|---|---|
| g | (3C) | 12 | " | " | " | " |
| h | Yellow filter layer composed of yellow colloidal silver (dry thickness:1.2μ) | — | " | " | " | " |
| i | (4A) | 6 | (4B) | 8 | (4B) | 8 |
| j | (4C) | 6 | (4D) | 8 | (4D) | 8 |
| k | (4E) | 10 | (4E) | 10 | (4F) | 6 |
| l | Gelatin protective layer (dry thickness:1.2μ) | — | Same as Film C | — | Same as Film C | — |

After exposure of these Films A to C to white light in an amount of 10 CMS, they were subjected to the same processing as in Example 1. When emulsions were applied in the silver content shown in Table 3, the fogging and the sensitivity in Films A to C were substantially equal to each other and the characteristic curves were nearly straight. The granularity (RMS) of these films is shown in Table 4 below.

TABLE 4

| Granularity (RMS) (at D = 0.6) | Film A | Film B | Film C |
|---|---|---|---|
| R | 0.040 | 0.040 | 0.040 |
| G | 0.045 | 0.045 | 0.045 |
| B | 0.050 | 0.070 | 0.100 |

As shown by the results in Table 4, the granularity is best in Film A and decreases in the order of Film B and Film C.

The image sharpness of the above-described films was then measured. This measurement was made by obtaining a response function (Modulation Transfer Function: hereinafter MTF) and comparing the MTF values in a certain frequency. The measurement of MTF was carried out according to Masao Takano and Ikuo Fujimura, *Hihakaido Kensa,* Vol. 16, pages 472–482 (1967). Exposure was carried out using white light in an amount of 10 CMS and the measurement was made through a red, green, or blue filter, respectively, in the R, G and B layers. The development was carried out according to the processing in Example 1.

The MTF values obtained are shown in Table 5 below. In Table 5, MTF values at a frequency of 20 per mm are shown. The table shows that the higher the MTF value is, the more excellent the description of the detailed image is, namely, the more excellent the image sharpness is.

TABLE 5

| MTF Valve (%) | Sample Film A | Film B | Film C |
|---|---|---|---|
| R | 78 | 68 | 54 |
| G | 86 | 78 | 62 |
| B | 93 | 91 | 88 |

As shown by the results in Table 5, the sharpness is the best in Film A and decreases in the order of Film B and Film C.

Similar results were obtained using DIR Compounds (D - 5) to (D - 7), (D - 16), (D - 17) and (D - 21) to (D - 24) instead of DIR Cyan Coupler (D - 13) used in Example 2. Further, similar results were obtained using DIR Compounds (D - 5) to (D - 7), (D - 12), (D - 17) and (D - 21) to (D - 24) instead of DIR Magenta Coupler (D - 10). Further, similar results were obtained using DIR Compounds (D - 7) to (D - 7), (D - 17) and (D - 21) to (D - 24) instead of DIR Yellow Coupler (D - 1).

While the invention has been described in detail and with reference to specific embodiments thereof, it will be apparent to one skilled in the art that various changes and modifications can be made therein without departing from the spirit and scope thereof.

What is claimed is:

1. In a silver halide multilayer color light-sensitive material comprising a red-sensitive silver halide emulsion layer, a green-sensitive silver halide emulsion layer and a blue-sensitive silver halide emulsion layer on a support, wherein each silver halide emulsion layer contains a non-diffusible image forming coupler, the improvement which comprises at least one of said silver halide emulsion layers comprising an upper unit silver halide emulsion layer, a middle unit silver halide emulsion layer and a lower unit silver halide emulsion layer, in which the sensitivity of the three unit silver halide emulsion layers decreases in order from the upper unit silver halide emulsion layer to the lower unit silver halide emulsion layer, wherein said upper unit silver halide emulsion layer comprises a layer of a high speed silver halide emulsion wherein more than about 3% based on the total grains in the upper unit silver halide emulsion comprises silver halide grains having a grain size of about 2.0μ or larger, and at least the middle unit silver halide emulsion layer contains at least one development inhibitor releasing compound selected from the compounds represented by the following general formulae (VII)–(X);

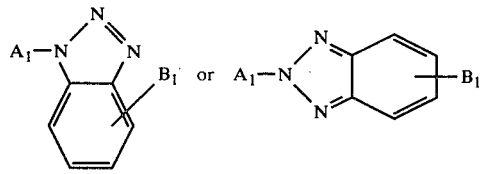

(VII)

wherein $A_1$ represents a yellow coupler residue, a magenta coupler residue, a cyan coupler residue, a malondiimide coupler residue, a malondiester coupler residue or an indanone coupling compound residue, and $B_1$ represents a bromine atom, an acylamino group, a benzothiazolinylideneamino group or an aralkyloxy group;

(VIII)

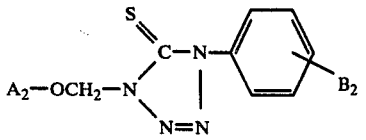

wherein $A_2$ represents a cyan coupler residue, and $B_2$ represents a halogen atom, a nitro group, an alkoxy group, an alkyl group, an amino group or an acylamino group;

(IX)

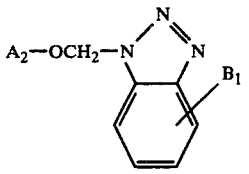

wherein $A_2$ has the same meaning as in the general formula (VIII) and $B_1$ has the same meaning as in the general formula (VIII); and (X)

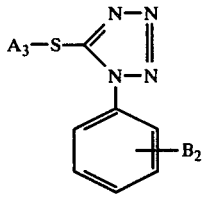

wherein $B_2$ has the same meaning as in the general formula (VIII) and $A_3$ represents a yellow coupler residue, a magenta coupler residue, a cyan coupler residue, a malondiimide coupler residue, a malondiester coupler residue, an indanone coupling compound residue or an α-(2-benzothia (or benzooxa)acetanilide) type coupler residue.

2. The multilayer color photographic light sensitive material of claim 1, wherein the grain size of the silver halide grains in said upper unit silver halide emulsion layer is preferably such that at least about 10% by weight, based on the total weight of the silver halide grains in the upper unit silver halide emulsion layer has a diameter of about 1.0μ or larger.

3. The multilayer color photographic light-sensitive material of claim 1, wherein the sensitivity difference between the upper unit silver halide emulsion layer, the middle unit silver halide emulsion layer and the lower unit silver halide emulsion layer is, respectively, about 0.15 log E to about 1.3 log E, about 0.1 log E to about 0.7 log E and about 0.3 log E to about 1.5 log E, wherein E is the amount of exposure in lux - seconds.

4. The multilayer color photographic light-sensitive material of claim 1, wherein the thickness of the upper unit silver halide emulsion layer, the thickness of the middle unit silver halide emulsion layer and the thickness of the lower unit silver halide emulsion layer is each about 0.5 to about 10μ.

5. The multilayer color photographic light-sensitive material of claim 1, wherein a coupler having a high coupling rate reactivity is incorporated in the upper unit silver halide emulsion layer having the highest sensitivity and a coupler having a low coupling rate reactivity is incorporated in the lower unit silver halide emulsion layer having the lowest sensitivity.

6. The multilayer color photographic light-sensitive material of claim 1, wherein the molar ratio of the silver halide in the upper unit silver halide emulsion layer to the coupler in the upper unit silver halide emulsion layer is about 20:1 to about 150:1.

7. The multilayer color photographic light-sensitive material of claim 1, wherein said DIR compound present in said middle unit silver halide emulsion layer is present in an amount of about 0.01 to about 40% on a molar basis to the total of the amount of the couplers in said middle unit silver halide emulsion layer.

8. The multilayer color photographic light-sensitive material of claim 1, wherein said red-sensitive silver halide emulsion layer, said green-sensitive silver halide emulsion layer and said blue-sensitive silver halide emulsion layer each comprises an upper unit silver halide emulsion layer, a middle unit silver halide emulsion layer and a lower unit silver halide emulsion layer.

9. The multilayer color light-sensitive material of claim 1, wherein said upper unit silver halide emulsion layer comprises a layer of a high speed silver halide emulsion wherein more than 5% based on the total grains in the upper unit emulsion layer to be composed of large grains having a grain size of about 2.0μ or larger.

10. The multilayer color light-sensitive material of claim 1, wherein the grain size of the silver halide grains in said upper unit silver halide emulsion layer is such that at least 20% by weight, based on the total weight of the silver halide grains in the upper unit silver halide emulsion layer has a diameter of about 1.0μ or larger.

11. The multilayer color light-sensitive material of claim 1, wherein the grain size of the silver halide grains in said upper unit silver halide emulsion layer is such that at least 40% by weight, based on the total weight of the silver halide grains in the upper unit silver halide emulsion layer has a diameter of about 1.0μ or larger.

12. The multilayer color light-sensitive material of claim 1, wherein the development inhibitor releasing compound is at least one of the compounds selected from the group consisting of D-1 - D-21 and D-24:

(DIR yellow Couplers)

D-1

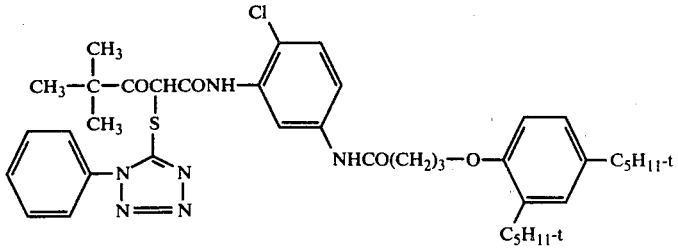

-continued
D-2
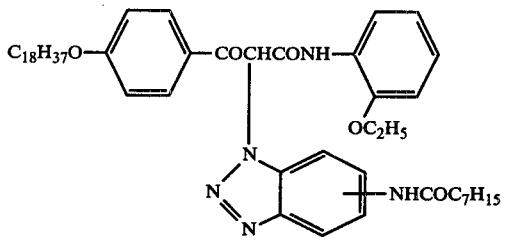
D-3
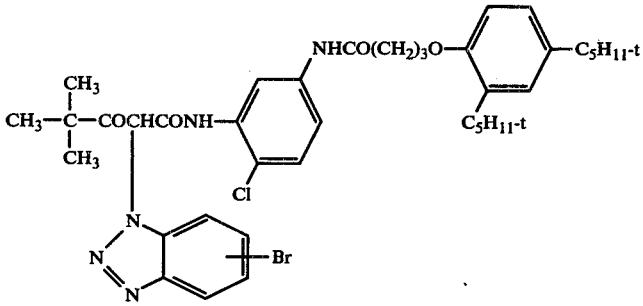
D-4
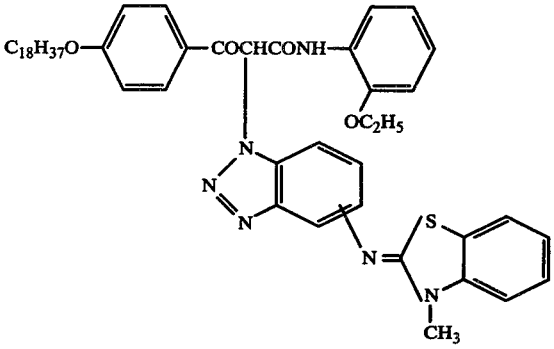
D-5
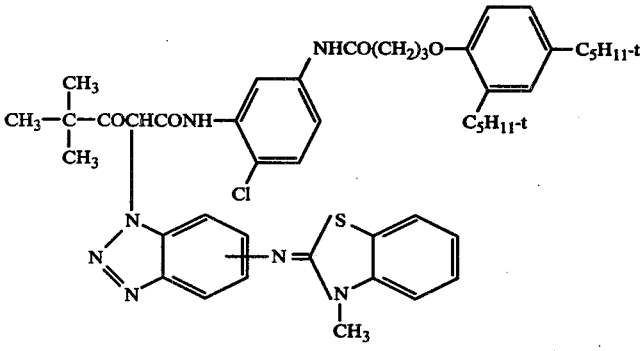
D-6
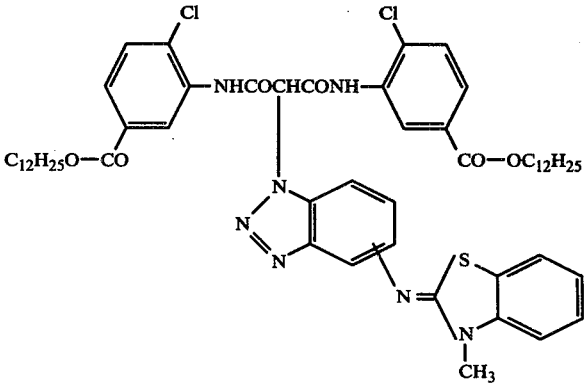

-continued
D-7
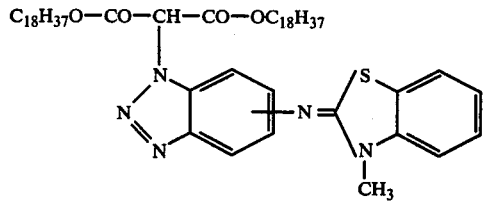
D-8
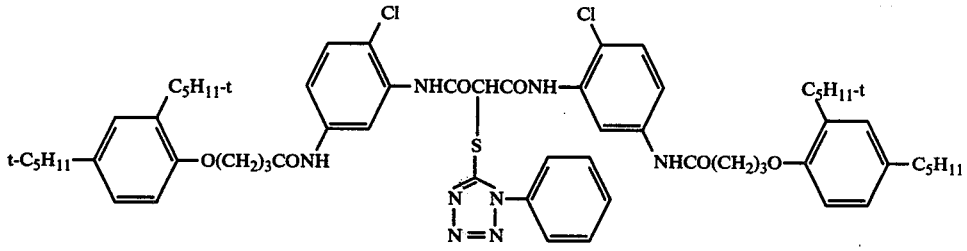
D-9
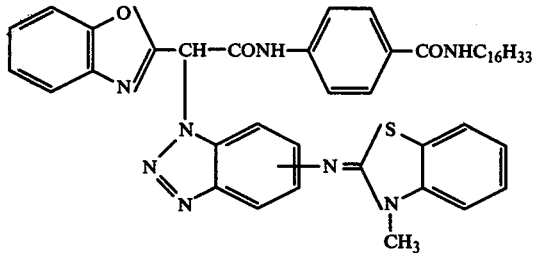
(DIR Magenta Couplers)
D-10
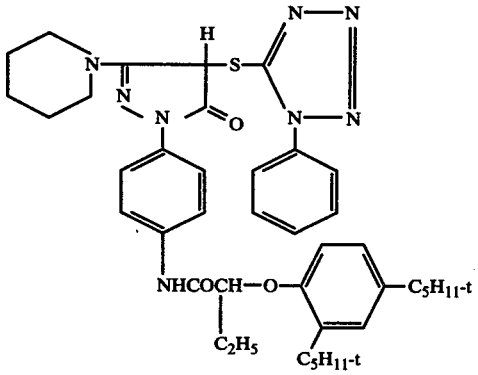
D-11
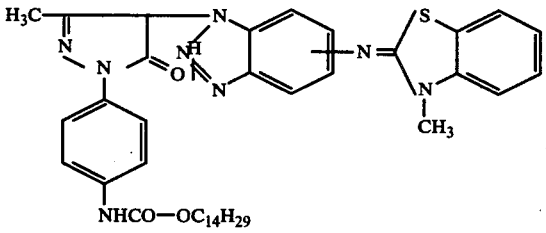
D-12
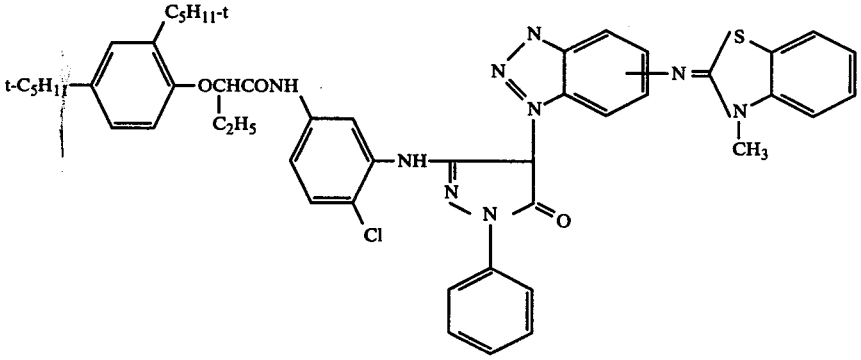

(DIR Cyan Couplers)
-continued
D-13
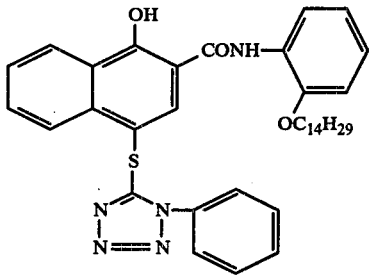
D-14
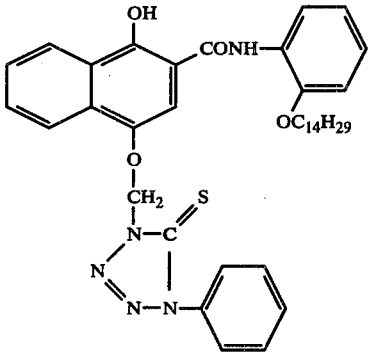
D-15
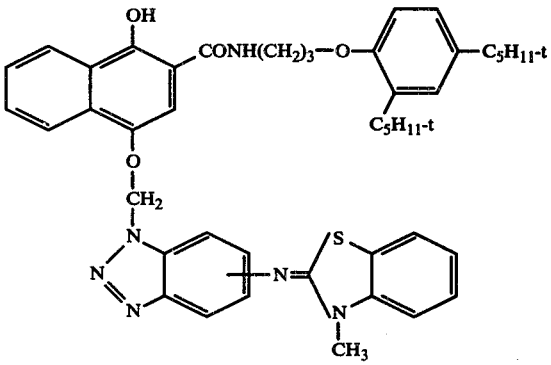
D-16
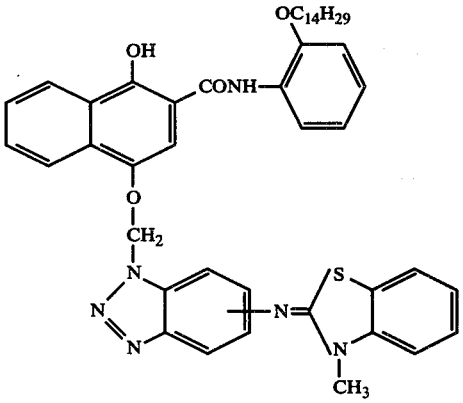

(Non-Color Forming DIR Coupling Compounds) -continued
D-17
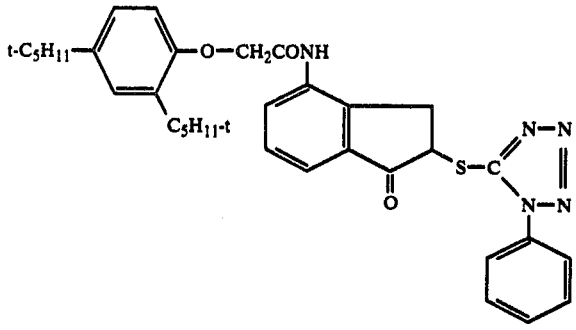
D-18
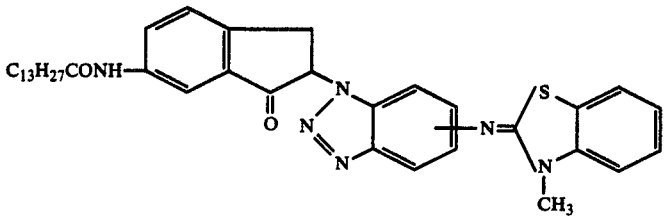
D-19
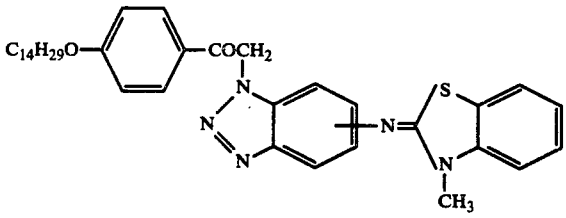
D-20
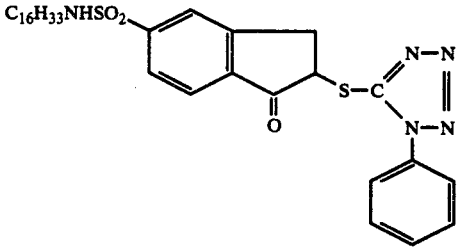
D-21
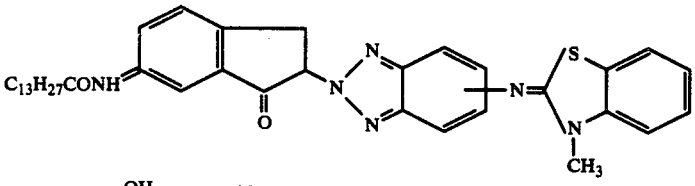
D-24
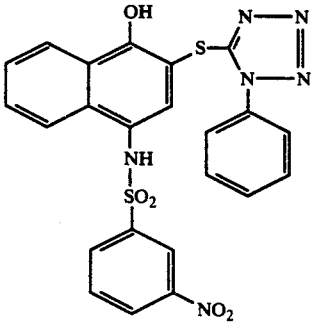
* * * * *